US009167662B2

(12) United States Patent
King et al.

(10) Patent No.: US 9,167,662 B2
(45) Date of Patent: Oct. 20, 2015

(54) MIXED LOAD CURRENT COMPENSATION FOR LED LIGHTING

(71) Applicant: Cirrus Logic, Inc., Austni, TX (US)

(72) Inventors: Eric J. King, Dripping Springs, TX (US); John L. Melanson, Austin, TX (US); Daniel J. Baker, Austin, TX (US); Mohit Sood, Austin, TX (US); Rahul Singh, Austin, TX (US)

(73) Assignee: Cirrus Logic, Inc., Austin, TX (US)

( * ) Notice: Subject to any disclaimer, the term of this patent is extended or adjusted under 35 U.S.C. 154(b) by 0 days.

(21) Appl. No.: 13/774,914

(22) Filed: Feb. 22, 2013

(65) Prior Publication Data

US 2013/0221871 A1 Aug. 29, 2013

Related U.S. Application Data

(60) Provisional application No. 61/604,740, filed on Feb. 29, 2012, provisional application No. 61/605,459, filed on Mar. 1, 2012.

(51) Int. Cl.
*H05B 37/02* (2006.01)
*H05B 33/08* (2006.01)

(52) U.S. Cl.
CPC ..... *H05B 37/02* (2013.01); *H05B 33/0815* (2013.01); *H05B 33/0845* (2013.01)

(58) Field of Classification Search
USPC ..... 315/250–254, 291, 294, 297, 209 R
See application file for complete search history.

(56) References Cited

U.S. PATENT DOCUMENTS 4,523,128 A 6/1985 Stamm et al.
5,055,746 A 10/1991 Hu et al.
(Continued)

FOREIGN PATENT DOCUMENTS

CN 1421986 A 6/2003
CN 1459216 A 11/2004
(Continued)

OTHER PUBLICATIONS

International Search Report and Written Opinion of the International Searching Authority mailed Jul. 17, 2013 in the corresponding PCT Application No. PCT/US2013/027507, 14 pgs.
(Continued)

*Primary Examiner* — Douglas W Owens
*Assistant Examiner* — Jonathan Cooper
(74) *Attorney, Agent, or Firm* — Terrile, Cannatti, Chambers & Holland, LLP; Kent B. Chambers

(57) ABSTRACT

In at least one embodiment, a system and method provide current compensation in a lighting system by controlling a lamp current to prevent a current through a triac-based dimmer from undershooting a holding current value. In at least one embodiment, at least one of the lamps includes a controller that controls circuitry in the lamp to draw more lamp current for a period of time than needed to illuminate a brightness of the lamp at a level corresponding to particular phase-cut angle of the supply voltage. By drawing more current than needed, the controller increases the dimmer current during the period of time to prevent the dimmer current from falling below the holding current value. In at least one embodiment, the period of time corresponds to a compensating pulse of the lamp current at a time when the dimmer current would otherwise fall below the holding current value.

35 Claims, 15 Drawing Sheets

(56) References Cited

U.S. PATENT DOCUMENTS

| | | | |
|---|---|---|---|
| 5,179,324 | A | 1/1993 | Audbert |
| 5,319,301 | A | 6/1994 | Callahan et al. |
| 5,321,350 | A | 6/1994 | Haas |
| 5,430,635 | A | 7/1995 | Liu |
| 5,604,411 | A | 2/1997 | Venkitasubrahmanian et al. |
| 5,629,607 | A | 5/1997 | Callahan et al. |
| 5,661,645 | A | 8/1997 | Hochstein |
| 5,691,605 | A | 11/1997 | Xia et al. |
| 5,770,928 | A | 6/1998 | Chansky et al. |
| 6,043,635 | A | 3/2000 | Downey |
| 6,046,550 | A | 4/2000 | Ference et al. |
| 6,091,205 | A | 7/2000 | Newman et al. |
| 6,211,624 | B1 | 4/2001 | Holzer |
| 6,380,692 | B1 | 4/2002 | Newman et al. |
| 6,407,514 | B1 | 6/2002 | Glaser et al. |
| 6,621,256 | B2 | 9/2003 | Muratov et al. |
| 6,713,974 | B2 | 3/2004 | Patcharnik et al. |
| 6,714,425 | B2 | 3/2004 | Yamada et al. |
| 6,858,995 | B2 | 2/2005 | Lee et al. |
| 6,900,599 | B2 | 5/2005 | Ribarich |
| 7,102,902 | B1 | 9/2006 | Brown et al. |
| 7,180,250 | B1 | 2/2007 | Gannon |
| 7,184,937 | B1 | 2/2007 | Su et al. |
| 7,339,329 | B2 | 3/2008 | Makimura et al. |
| 7,656,103 | B2 | 2/2010 | Shteynberg et al. |
| 7,719,246 | B2 | 5/2010 | Melanson |
| 7,728,530 | B2 | 6/2010 | Wang et al. |
| 7,733,678 | B1 | 6/2010 | Notohamiprodjo et al. |
| 7,750,580 | B2 | 7/2010 | Lu et al. |
| 7,759,881 | B1 | 7/2010 | Melanson |
| 7,786,711 | B2 | 8/2010 | Wei et al. |
| 7,872,427 | B2 | 1/2011 | Scianna |
| 7,982,415 | B2 | 7/2011 | Kimura |
| 8,102,167 | B2 | 1/2012 | Irissou et al. |
| 8,115,419 | B2 | 2/2012 | Given et al. |
| 8,169,154 | B2 | 5/2012 | Thompson et al. |
| 8,212,491 | B2 | 7/2012 | Kost |
| 8,212,492 | B2 | 7/2012 | Lam et al. |
| 8,222,832 | B2 | 7/2012 | Zheng et al. |
| 8,482,220 | B2 | 7/2013 | Melanson |
| 8,487,546 | B2 | 7/2013 | Melanson |
| 8,508,147 | B2 | 8/2013 | Shen |
| 8,536,794 | B2 | 9/2013 | Melanson et al. |
| 8,536,799 | B1 | 9/2013 | Grisamore et al. |
| 8,547,034 | B2 | 10/2013 | Melanson et al. |
| 8,569,972 | B2 | 10/2013 | Melanson |
| 8,581,518 | B2 | 11/2013 | Kuang et al. |
| 8,610,364 | B2 | 12/2013 | Melanson et al. |
| 8,610,365 | B2 | 12/2013 | King et al. |
| 8,664,885 | B2 | 3/2014 | Koolen et al. |
| 8,716,957 | B2 | 5/2014 | Melanson et al. |
| 8,749,173 | B1 | 6/2014 | Melanson et al. |
| 8,847,515 | B2 | 9/2014 | King et al. |
| 2002/0140371 | A1 | 10/2002 | Chou et al. |
| 2004/0105283 | A1 | 6/2004 | Schie et al. |
| 2004/0212321 | A1 | 10/2004 | Lys |
| 2006/0022648 | A1 | 2/2006 | Ben-Yaakov et al. |
| 2006/0208669 | A1 | 9/2006 | Huynh et al. |
| 2007/0182338 | A1 | 8/2007 | Shteynberg |
| 2007/0182347 | A1 | 8/2007 | Shteynberg |
| 2008/0018261 | A1 | 1/2008 | Kastner |
| 2008/0101098 | A1 | 5/2008 | Disney |
| 2008/0143266 | A1 | 6/2008 | Langer |
| 2008/0192509 | A1 | 8/2008 | Dhuyvetter et al. |
| 2008/0203934 | A1 | 8/2008 | Van Meurs |
| 2008/0205103 | A1 | 8/2008 | Sutardja et al. |
| 2008/0224629 | A1 | 9/2008 | Melanson |
| 2008/0224633 | A1 | 9/2008 | Melanson |
| 2008/0224636 | A1 | 9/2008 | Melanson |
| 2009/0134817 | A1 | 5/2009 | Jurngwirth et al. |
| 2009/0135632 | A1 | 5/2009 | Sohma |
| 2009/0195186 | A1 | 8/2009 | Guest et al. |
| 2009/0284182 | A1 | 11/2009 | Cencur |
| 2010/0002480 | A1 | 1/2010 | Huynh et al. |
| 2010/0013405 | A1 | 1/2010 | Thompson et al. |
| 2010/0013409 | A1 | 1/2010 | Quek et al. |
| 2010/0066328 | A1 | 3/2010 | Shimizu et al. |
| 2010/0164406 | A1 | 7/2010 | Kost et al. |
| 2010/0213859 | A1 | 8/2010 | Shteynberg et al. |
| 2010/0231136 | A1 | 9/2010 | Reisenauer et al. |
| 2010/0244726 | A1 | 9/2010 | Melanson |
| 2011/0043133 | A1 | 2/2011 | Van Laanen et al. |
| 2011/0080110 | A1 | 4/2011 | Nuhfer et al. |
| 2011/0084622 | A1 | 4/2011 | Barrow et al. |
| 2011/0084623 | A1 | 4/2011 | Barrow |
| 2011/0115395 | A1 | 5/2011 | Barrow et al. |
| 2011/0121754 | A1 | 5/2011 | Shteynberg |
| 2011/0148318 | A1 | 6/2011 | Shackle et al. |
| 2011/0204797 | A1 | 8/2011 | Lin et al. |
| 2011/0204803 | A1* | 8/2011 | Grotkowski et al. ..... 315/194 |
| 2011/0234115 | A1 | 9/2011 | Shimizu et al. |
| 2011/0266968 | A1 | 11/2011 | Bordin et al. |
| 2011/0291583 | A1 | 12/2011 | Shen |
| 2011/0309759 | A1 | 12/2011 | Shteynberg et al. |
| 2011/0316441 | A1 | 12/2011 | Huynh |
| 2012/0049752 | A1 | 3/2012 | King et al. |
| 2012/0068626 | A1 | 3/2012 | Lekatsas et al. |
| 2012/0098454 | A1* | 4/2012 | Grotkowski et al. ..... 315/246 |
| 2012/0112651 | A1 | 5/2012 | King et al. |
| 2012/0133291 | A1* | 5/2012 | Kitagawa et al. ..... 315/186 |
| 2012/0286686 | A1 | 11/2012 | Watanabe et al. |
| 2013/0015768 | A1* | 1/2013 | Roberts et al. ..... 315/122 |
| 2013/0154495 | A1 | 6/2013 | He |
| 2013/0193879 | A1 | 8/2013 | Sadwick et al. |
| 2014/0009082 | A1 | 1/2014 | King et al. |

FOREIGN PATENT DOCUMENTS

| | | | |
|---|---|---|---|
| CN | 1748446 | A | 3/2006 |
| CN | 1843061 | A1 | 10/2006 |
| CN | 101164383 | A | 4/2008 |
| CN | 101505568 | A | 8/2009 |
| CN | 101805568 | A | 8/2009 |
| CN | 101707874 | A | 5/2010 |
| CN | 101835314 | | 9/2010 |
| CN | 101926222 | | 12/2010 |
| EP | 1164819 | | 12/2001 |
| EP | 2257124 | A1 | 1/2010 |
| EP | 2232949 | | 9/2010 |
| JP | 2008053181 | A | 3/2008 |
| JP | 2009170240 | A | 7/2009 |
| WO | 9917591 | | 4/1999 |
| WO | 02096162 | | 11/2002 |
| WO | 2006079937 | | 8/2006 |
| WO | 2008029108 | | 3/2008 |
| WO | 2008112822 | A2 | 9/2008 |
| WO | 2010011971 | A1 | 1/2010 |
| WO | WO2010011971 | A1 | 1/2010 |
| WO | 2010027493 | A2 | 3/2010 |
| WO | 2010035155 | A2 | 4/2010 |
| WO | 2011008635 | A1 | 1/2011 |
| WO | 2011056068 | A2 | 5/2011 |
| WO | WO2011050453 | A1 | 5/2011 |
| WO | WO2012016197 | A1 | 2/2012 |

OTHER PUBLICATIONS

Supertex, Inc., HV9931 Unity Power Factor LED Lamp Driver, pp. 1-7, 2005, Sunnyvale, California, USA. (Per MPEP 609.04(a), Applicant points out that the year of publication is sufficiently earlier than the effective U.S. fiing date and any foreign priority date so that the particular month of publication is not in issue.).

Wang Xiao, Phase Control Dimming of the Dimmable Lighting System, Journal of Wuxi University of Light Industry, Jul. 31, 2000, vol. 19, No. 4, pp. 1-3. The Abstract contains a concise explanation in English and the Search Report identifies the following portions as related to the claims in the Present Application: p. 408, right-hand column, section 2, and figures 5-7.

Supertex, Inc., HV9931 Unity Power Factor LED Lamp Driver, pp. 1-7, 2005, Sunnyvale, California, USA. (Per MPEP 609.04(a), Applicant points out that the year of publication is sufficiently earlier than the effective U.S. filing date and any foreign priority date so that the particular month of publication is not in issue.).

(56) References Cited

OTHER PUBLICATIONS

Response to the Written Opinion accompanying the International Report on Patentability as filed in European Patent Application No. 13710654.8 on May 27, 2015, pp. 1-24.
Azoteq, IQS17 Family, IQ Switch—ProxSense Series, Touch Sensor, Load Control and User Interface, IQS17 Datasheet V2.00.doc, Jan. 2007, pp. 1-51, Azoteq (Pty) Ltd., Paarl, Western Cape, Republic of South Africa.
Chan, Samuel, et al, Design and Implementation of Dimmable Electronic Ballast Based on Integrated Inductor, IEEE Transactions on Power Electronics, vol. 22, No. 1, Jan. 2007, pp. 291-300, Dept. of Electron. Eng., City Univ. of Hong Kong.
Rand, Dustin, et al, Issues, Models and Solutions for Triac Modulated Phase Dimming of LED Lamps, Power Electronics Specialists Conference, 2007. PESC 2007. IEEE, Jun. 17-21, 2007, pp. 1398-1404, Boston, MA, USA.
Gonthier, Laurent, et al, EN55015 Compliant 500W Dimmer with Low-Losses Symmetrical Switches, ST Microelectronics, Power Electronics and Applications, 2005 European Conference, pp. 1-9, Aug. 7, 2006, Dresden.
Green, Peter, A Ballast That Can Be Dimmed from a Domestic (Phase Cut) Dimmer, International Rectifier, IRPLCFL3 rev.b, pp. 1-12, Aug. 15, 2003, El Segundo, California, USA.
Hausman, Don, Real-Time Illumination Stability Systems for Trailing-Edge (Reverse Phase Control) Dimmers, Lutron RTISS, Lutron Electronics Co, Dec. 2004, pp. 1-4, Coopersburg, PA, USA.
Lee, Stephen, et al, A Novel Electrode Power Profiler for Dimmable Ballasts Using DC Link Voltage and Switching Frequency Controls, IEEE Transactions on Power Electronics, vol. 19, No. 3, May 2004, pp. 847-833, City University of Hong Kong.
Engdahl, Tomi, Light Dimmer Circuits, 1997-2000, www.epanorama.net.
O'Rourke, Conan, et al, Dimming Electronic Ballasts, National Lighting Product Information Program, Specifier Reports, vol. 7, No. 3, Oct. 1999, pp. 1-24, Troy, NY, USA.
Supertex Inc, 56W Off-line LED Driver, 120VAC with PFC, 160V, 350mA Load, Dimmer Switch Compatible, DN-H05, pp. 1-20, Jun. 17, 2008, Sunnyvale, California, USA.
Lutron, Fluorescent Dimming Systems Technical Guide, copyright 2002, Why Different Dimming Ranges, http://www.lutron.com/TechnicalDocumentLibrary/LutronBallastpg3.pdf, p. 3, Coopersburg PA, USA.
Wu, Tsai-Fu, et al, Single-Stage Electronic Ballast with Dimming Feature and Unity Power Factor, IEEE Transactions on Power Electronics, vol. 13, No. 3, May 1998, pp. 586-597.
Amanci, et al, "Synchronization System with Zero-Crossing Peak Detection Algorithm for Power System Applications", The 2010 International Power Electronics Conference, pp. 2984-2991, Toronto, Ontario, Canada.
Patterson, James, "Efficient Method for Interfacing Triac Dimmers and LEDs", National Semiconductor Corp., pp. 29-32, Jun. 23, 2011, USA.
Vainio, Olli, "Digital Filtering for Robust 50/60 Hz Zero-Crossing Detectors", IEEE Transactions on Instrumentation and Measurement, vol. 45, No. 2, pp. 426-430, Apr. 1996, University of Santa Barbara, California, USA.

* cited by examiner

MIXED LOAD CURRENT COMPENSATION FOR LED LIGHTING

CROSS-REFERENCE TO RELATED APPLICATION

This application claims the benefit under 35 U.S.C. §119 (e) and 37 C.F.R. §1.78 of U.S. Provisional Application No. 61/604,740, filed on Feb. 29, 2012 and U.S. Provisional Application No. 61/605,459 filed on Mar. 1, 2012, which are both incorporated by reference in their entireties.

FIELD OF THE INVENTION

The present invention relates in general to the field of electronics, and, more specifically, to a system and method for providing mixed load current compensation for LED lighting.

DESCRIPTION OF THE RELATED ART

Commercially practical incandescent light bulbs have been available for over 100 years. However, other light sources show promise as commercially viable alternatives to the incandescent light bulb. Light Emitting Diodes ("LEDs") are becoming particularly attractive as main stream light sources in part because of energy savings through high efficiency light output, long life, and environmental incentives such as the reduction of mercury.

LEDs are semiconductor devices and are best driven by direct current. The brightness of the LED varies in direct proportion to the current flowing through the LED. Thus, increasing current supplied to an LED increases the brightness of the LED and decreasing current supplied to the LED dims the LED.

Dimming a light source saves energy when operating a light source and also allows a user to adjust the brightness of the light source to a desired level. Many facilities, such as homes and buildings, include light source dimming circuits (referred to herein as "dimmers").

Electronic systems utilize dimmers to direct modification of output power to a load. For example, in a lighting system, dimmers provide an input signal to a lighting system. The input signal represents a dimming level that causes the lighting system to adjust power delivered to a lamp, and, thus, depending on the dimming level, increase or decrease the brightness of the lamp. Many different types of dimmers exist. In general, dimmers use a digital or analog coded dimming signal that indicates a desired dimming level. For example, some analog based dimmers utilize a triode for alternating current ("triac") device to modulate a phase angle of each cycle of an alternating current ("AC") supply voltage. "Modulating the phase angle" of the supply voltage is also commonly referred to as "chopping" the supply voltage. Chopping the supply voltage causes the voltage supplied to a lighting system to rapidly turn "ON" and "OFF," thereby controlling the energy provided to a lighting system.

FIG. 1 depicts a lighting system 100 that includes a triac-based dimmer 102. FIG. 2 depicts exemplary voltage graphs 200 associated with the lighting system 100. Referring to FIGS. 1 and 2, the lighting system 100 receives an AC supply voltage $V_{SUPPLY}$ from voltage supply 104. The supply voltage $V_{SUPPLY}$ is, for example, a nominally 60 Hz/110 V line voltage in the United States of America or a nominally 50 Hz/220 V line voltage in Europe. Triac 106 acts as voltage-driven switch, and a gate terminal 108 of triac 106 controls current flow between the first terminal 110 and the second terminal 112 of the triac 106. A gate voltage $V_G$ on the gate terminal 108 causes the triac 106 to turn ON and conduct current $i_{DIM}$ when the gate voltage $V_G$ reaches a firing threshold voltage value $V_F$ and a voltage potential exists across the first and second terminals 110 and 112. Ideally, the dimmer output voltage $V_{\phi_DIM}$ is zero volts from the beginning of each of half cycles 202 and 204 at respective times $t_0$ and $t_2$ until the gate voltage $V_G$ reaches the firing threshold voltage value $V_F$. Dimmer output voltage $V_{\phi_DIM}$ represents the output voltage of dimmer 102. During timer period $T_{OFF}$, the dimmer 102 chops the supply voltage $V_{SUPPLY}$ so that the dimmer output voltage $V_{\phi_DIM}$ ideally remains at zero volts during time period $T_{OFF}$. At time $t_1$, the gate voltage $V_G$ reaches the firing threshold value $V_F$, and triac 106 begins conducting. Once triac 106 turns ON, the dimmer voltage $V_{\phi_DIM}$ ideally tracks the supply voltage $V_{SUPPLY}$ during time period $T_{ON}$. Once triac 106 turns ON, triac 106 continues to conduct current $i_{DIM}$ regardless of the value of the gate voltage $V_G$ as long as the current $i_{DIM}$ remains above a holding current value HC. The holding current value HC is a function of the physical characteristics of the triac 106. Once the current $i_{DIM}$ drops below the holding current value HC, i.e. $i_{DIM}$<HC, triac 106 turns OFF, i.e. stops conducting, until the gate voltage $V_G$ again reaches the firing threshold value $V_F$. The holding current value HC is generally low enough so that, ideally, the current $i_{DIM}$ drops below the holding current value HC when the supply voltage $V_{SUPPLY}$ is approximately zero volts near the end of the half cycle 202 at time $t_2$.

The variable resistor 114 in series with the parallel connected resistor 116 and capacitor 118 form a timing circuit 115 to control the time $t_1$ at which the gate voltage $V_G$ reaches the firing threshold value $V_F$. Increasing the resistance of variable resistor 114 increases the time $T_{OFF}$, and decreasing the resistance of variable resistor 114 decreases the time $T_{OFF}$. The resistance value of the variable resistor 114 effectively sets a dimming value for lamp 122. Diac 119 provides current flow into the gate terminal 108 of triac 106. The dimmer 102 also includes an inductor choke 120 to smooth the dimmer output voltage $V_{\phi_DIM}$. Triac-based dimmer 102 also includes a capacitor 121 connected across triac 106 and inductor 120 to reduce electro-magnetic interference.

Ideally, modulating the phase angle of the dimmer output voltage $V_{\phi_DIM}$ effectively turns the lamp 122 OFF during time period $T_{OFF}$ and ON during time period $T_{ON}$ for each half cycle of the supply voltage $V_{SUPPLY}$. Thus, ideally, the dimmer 102 effectively controls the average energy supplied to the lamp 122 in accordance with the dimmer output voltage $V_{\phi_DIM}$.

The triac-based dimmer 102 adequately functions in many circumstances. However, when the lamp 122 draws a small amount of current $i_{DIM}$, the current $i_{DIM}$ can prematurely drop below the holding current value HC before the supply voltage $V_{SUPPLY}$ reaches approximately zero volts. When the current $i_{DIM}$ prematurely drops below the holding current value HC, the dimmer 102 prematurely shuts down, and the dimmer voltage $V_{\phi_DIM}$ will prematurely drop to zero. When the dimmer voltage $V_{\phi_DIM}$ prematurely drops to zero, the dimmer voltage $V_{\phi_DIM}$ does not reflect the intended dimming value as set by the resistance value of variable resistor 114. For example, when the current $i_{DIM}$ drops below the holding current value HC at time $t_3$ for the dimmer voltage $V_{\phi_DIM}$ 206, the ON time period $T_{ON}$ prematurely ends at a time earlier than $t_2$, such as time $t_3$, instead of ending at time $t_2$, thereby decreasing the amount of energy delivered to the N electronic lamps 122.1, 122.2, . . . , 122.N, where N is an integer reference greater than 1.

FIG. 3 depicts a peak-rectified LED-based lamp 300, which represents an exemplary electronic lamp 122. A full-bridge diode rectifier 302 rectifies the dimmer voltage $V_{\phi_DIM}$ to provide a rectified voltage $V_x(t)$ to the switching power converter 304. A controller 306 receives a SENSE signal, which, for example, represents the rectified voltage $V_x(t)$ and the LED voltage $V_{LED}$. The controller 306 generates a control signal $CS_0$ to cause the switching power converter 304 to convert the rectified voltage $V_x(t)$ into the LED voltage $V_{LED}$ and provide an LED drive current $i_{LED}$ to the LED 308. Since the value of the LED drive current $i_{LED}$ directly relates to the brightness of the LED 308, the switching power converter 304 controls the value of the LED drive current $i_{LED}$ so that the value of the LED drive current $i_{LED}$ is proportional to the phase-cut angle of the dimmer voltage $V_{\phi_DIM}$. Thus, ideally the brightness of the LED 308 directly corresponds to the phase-cut angle of the dimmer voltage $V_{\phi_DIM}$.

FIG. 4 depicts exemplary voltage and current waveforms associated with the peak-rectified LED-based lamp 300. Referring to FIGS. 3 and 4, the controller 306 senses the dimmer voltage $V_{\phi_DIM}$ and determines the amount of LED drive current $i_{LED}$ to provide to the LED 308 for each cycle of the dimmer voltage $V_{\phi_DIM}$. Beginning at each leading edge of the dimmer voltage $V_{\phi_DIM}$, the controller 306 draws an amount of the dimmer current $i_{LAMP}$ for LED-based lamp 300 sufficient to provide the determined LED drive current $i_{LED}$. Because the electronic lamps 122.1-122.N are configured in parallel, the dimmer current $i_{LAMP}$ represents a portion of the dimmer current $i_{DIM}$ in accordance with Kirchoff's current law. The peak-rectified-type embodiment of the LED-based lamp 300 is designed to draw the dimmer current $i_{LAMP}$ relatively quickly, thus, creating relatively large positive and negative changes in the dimmer current dimmer current $i_{LAMP}$ over time, i.e. relatively large positive and negative di/dt's. Thus, the current profiles, such as current profiles 402, 404, 406, and 408, are zero amps ("0 A") until an occurrence of a leading edge 418, 420, 422, and 424 of the dimmer voltage $V_{\phi_DIM}$ followed by a short duration, punctuated current with relatively large di/dt's, and then 0 A for the remainder of each positive half-line cycle 410 and 414 and each negative half-line cycle 412 and 416 of the dimmer voltage $V_{\phi_DIM}$.

Referring to FIG. 1, lamps 122.1-122.N may be homogenous, i.e. the same, or a mix of two or more different types of LED-based lamps. For example, one or more proper subsets of the lamps 122.1-122.N may have a different type of controller or embedded switching power converter (not shown) than the remaining lamps. When the triac-based dimmer provides the dimmer voltage $V_{\phi_DIM}$ to multiple electronic lamps 122.1-122.N, particularly to a mix of different types of lamps, one or more of the electronic lamps 122.1-122.N may operate in a noticeably non-ideal manner. Examples of a noticeably non-ideal manner include abnormal light flicker and shortened efficacy.

SUMMARY OF THE INVENTION

In one embodiment of the present invention, a method includes detecting a leading edge of a dimmer phase-cut voltage and after detecting the leading edge, controlling a lamp current of an electronic lamp to prevent a current through a triac of the dimmer from undershooting a holding current value. The holding current value represents a value that if undershot by the current through the triac of the dimmer would stop the triac from conducting. The method further includes preventing the current through the dimmer from undershooting the holding current value.

In another embodiment of the present invention, an apparatus includes a controller. The controller is configured to detect a leading edge of a dimmer phase-cut voltage and, after detecting the leading edge, controlling a lamp current of an electronic lamp to prevent a current through a triac of the dimmer from undershooting a holding current value. The holding current value represents a value that if undershot by the current through the triac of the dimmer would stop the triac from conducting. The controller is further configured to prevent the current through the dimmer from undershooting the holding current value.

In a further embodiment of the present invention, an apparatus includes a lamp, wherein the lamp comprises a switching power converter, one or more light emitting diodes coupled to the switching power converter, and a controller, coupled to the switching power converter. The controller is configured to detect a leading edge of a dimmer phase-cut voltage and, after detecting the leading edge, controlling a lamp current of an electronic lamp to prevent a current through a triac of the dimmer from undershooting a holding current value. The holding current value represents a value that if undershot by the current through the triac of the dimmer would stop the triac from conducting. The controller is further configured to prevent the current through the dimmer from undershooting the holding current value.

BRIEF DESCRIPTION OF THE DRAWINGS

The present invention may be better understood, and its numerous objects, features and advantages made apparent to those skilled in the art by referencing the accompanying drawings. The use of the same reference number throughout the several figures designates a like or similar element.

DETAILED DESCRIPTION

Figure 1:
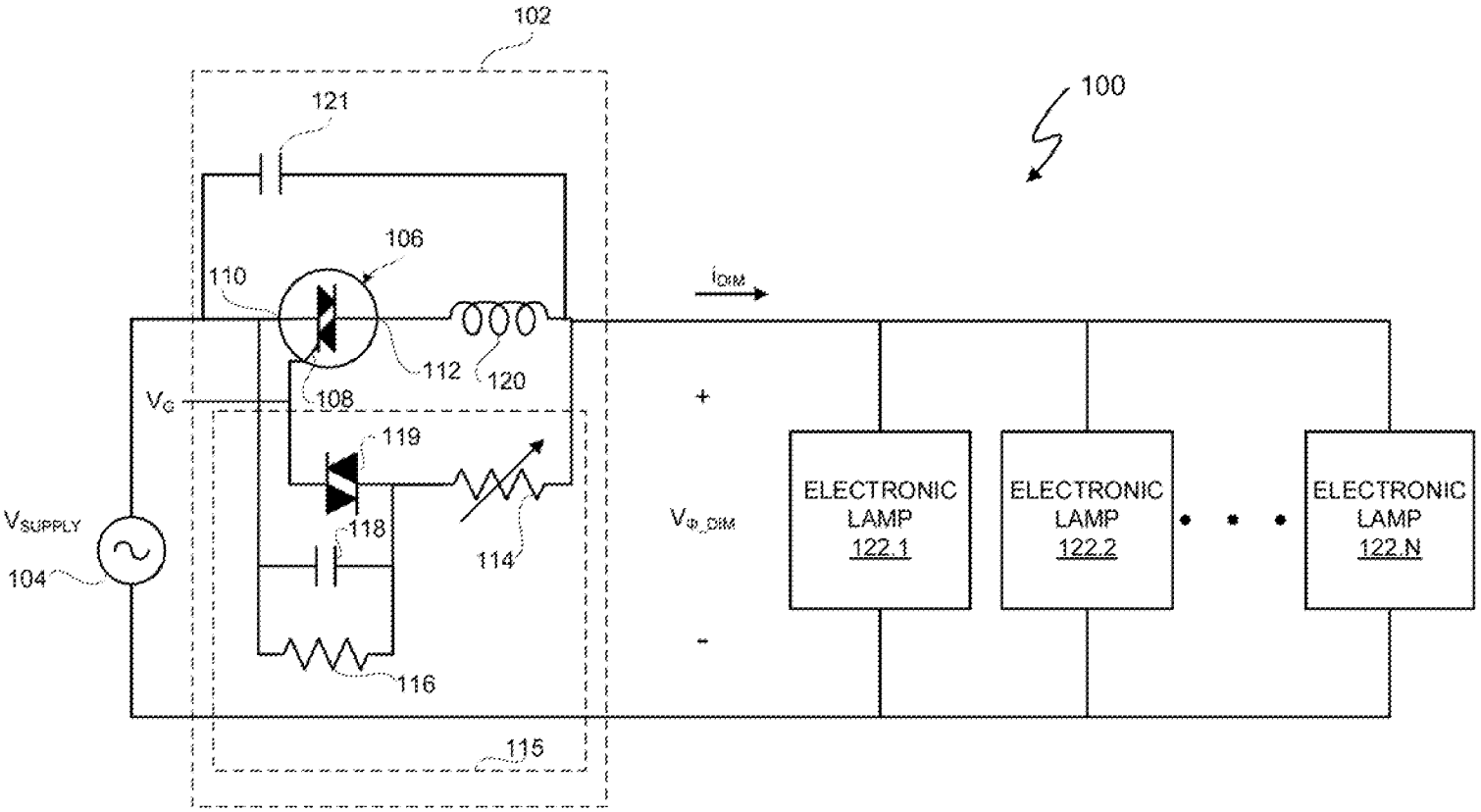
FIG. 1 (Prior Art)
FIG. 1 (labeled prior art) depicts a lighting system that includes a triac-based dimmer.
Figure 2:
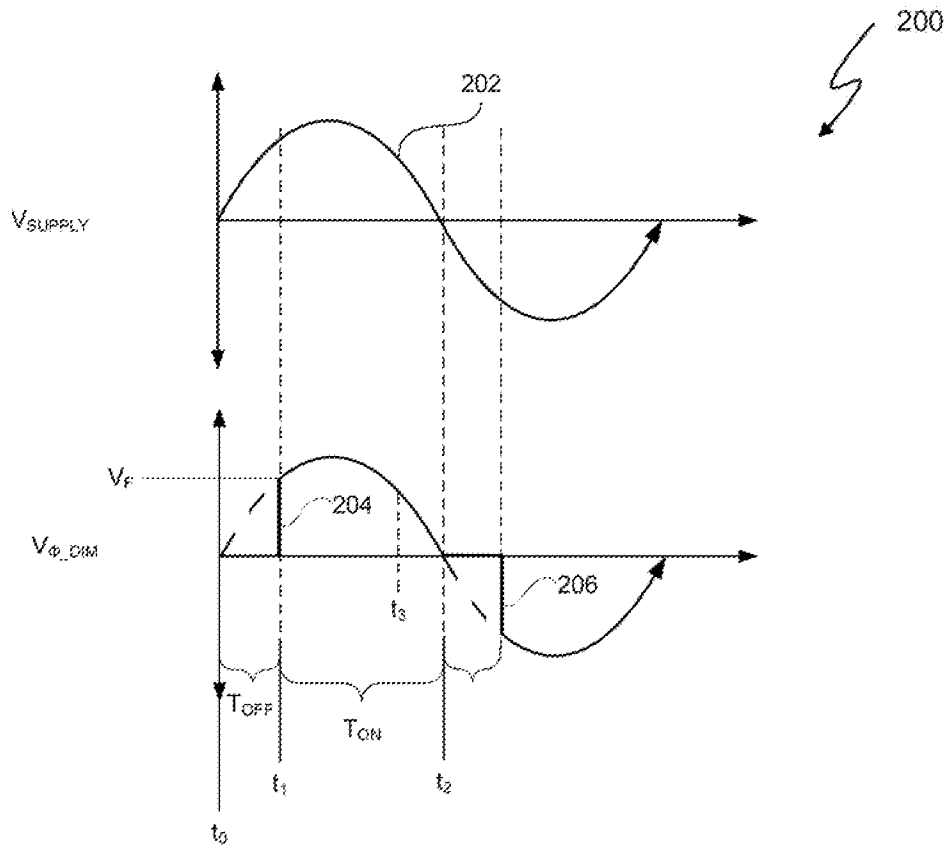
FIG. 2 (PRIOR ART)
FIG. 2 (labeled prior art) depicts exemplary voltage graphs associated with the lighting system of FIG. 1.
Figure 3:
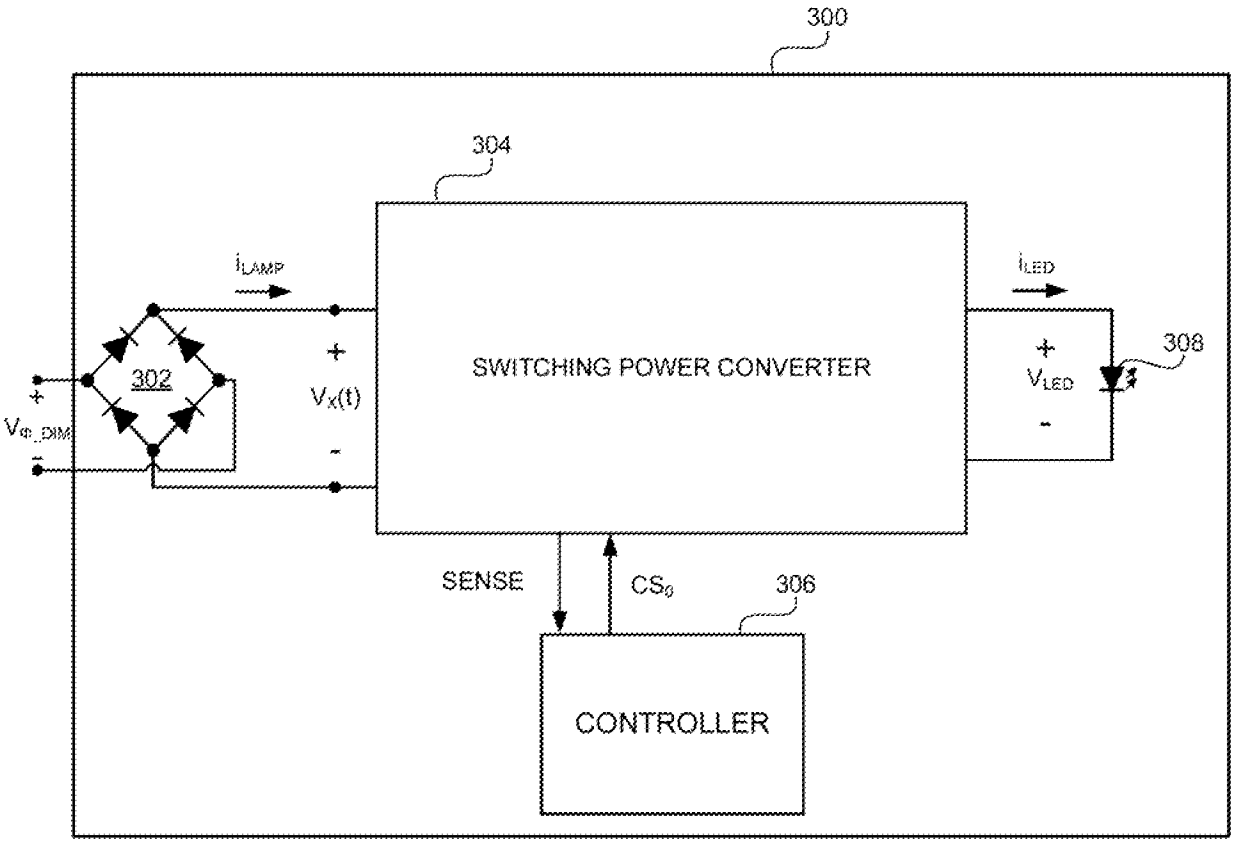
FIG. 3 (PRIOR ART)
FIG. 3 (labeled prior art) depicts a peak-rectified LED-based lamp

In at least one embodiment, a system and method provide current compensation in a lighting system by controlling a lamp current to prevent a current through a triac of a triac-based dimmer from undershooting a holding current value. The "holding current value" is a value of the current through the dimmer below which the dimmer would stop conducting. In at least one embodiment, when a lighting system includes electronic lamps configured in parallel and also includes a triac-based dimmer to phase-cut a supply voltage, the lamps can cause the current through the triac-based dimmer (referred to as the "dimmer current") to prematurely drop below the holding current value. If the dimmer current prematurely drops below the holding current value, the triac will prematurely stop conducting during a then-current half-line cycle of a supply voltage. The premature cessation of current conduction by the dimmer can cause the lamps to behave in a noticeably non-ideal manner, such as exhibiting abnormal light flicker and shortened efficacy. The possibility of the premature cessation of dimmer current is particularly acute when the lamps present a mixed set of loads. In this context, a mixed set of loads refers to a non-homogenous set of lamps. For example, in a peak rectified lamp, the lamp current is aggressively drawn near a leading edge of the dimmer voltage, which results in a relatively large negative change in lamp current over time, i.e. −di/dt. Other lamps draw lamp current over a longer period of time and, thus, have a relatively smaller negative change in lamp current over time. The large negative di/dt can cause the dimmer current to fall below the holding current value, particularly with a set of lamps representing a mixed set of loads. "Electronic lamp" refers to lamps with electronics that actively control current to the light source of the lamp. Exemplary electronic lamps include light emitting diode (LED) based lamps and compact fluorescent lamps.

In at least one embodiment, at least one of the lamps includes a controller that controls circuitry in the lamp to draw more lamp current for a period of time than needed to illuminate a brightness of the lamp at a level corresponding to particular phase-cut angle of the supply voltage. By drawing more current than needed, the controller increases the dimmer current during the period of time to prevent the dimmer current from falling below the holding current value. In at least one embodiment, the period of time corresponds to a compensating pulse of the lamp current at a time when the dimmer current would otherwise fall below the holding current value. The particular start time and duration of the compensating current pulse are a matter of design choice, and in at least one embodiment, are determined empirically by testing various combinations of lamps configured in parallel in a lighting system and determining when the dimmer current will fall below the holding current value in the absence of the compensating current pulse. In at least one embodiment, at least the particular start time of the compensating current pulse is determined dynamically by sensing an indication of a possible undershoot of the holding current value. The particular shape of the compensating current pulse is a matter of design choice. In at least one embodiment, the compensating current pulse rises quickly and ramps down at a slower rate than the rising rate.

A dimmer voltage supplied to the lamp can be unrectified or rectified. A current through the triac of the triac-based dimmer "undershooting a holding current value" refers to an event when the current through the triac reaches a value that will cause the dimmer to stop conducting. In mathematical terms, when an absolute value of the current through the triac is less than an absolute value of the holding current value, the current through the triac undershoots the holding current value. In observational terms, during a positive voltage half-cycle of the dimmer voltage, the current through the triac undershoots the holding current value when the current through the triac is less than the holding current value, and during a negative half-cycle of the dimmer voltage, the current through the triac undershoots the holding current value when the current through the triac is greater than the holding current value. Additionally, in at least one embodiment, the holding current value for the positive half-cycle of the dimmer voltage may be the same or different from the holding current value for the negative half-cycle of the dimmer voltage. The particular holding current value(s) are a function of the particular triac used in the triac-based dimmer and can be obtained from a manufacturer of the dimmer or obtained empirically.

Figure 4:
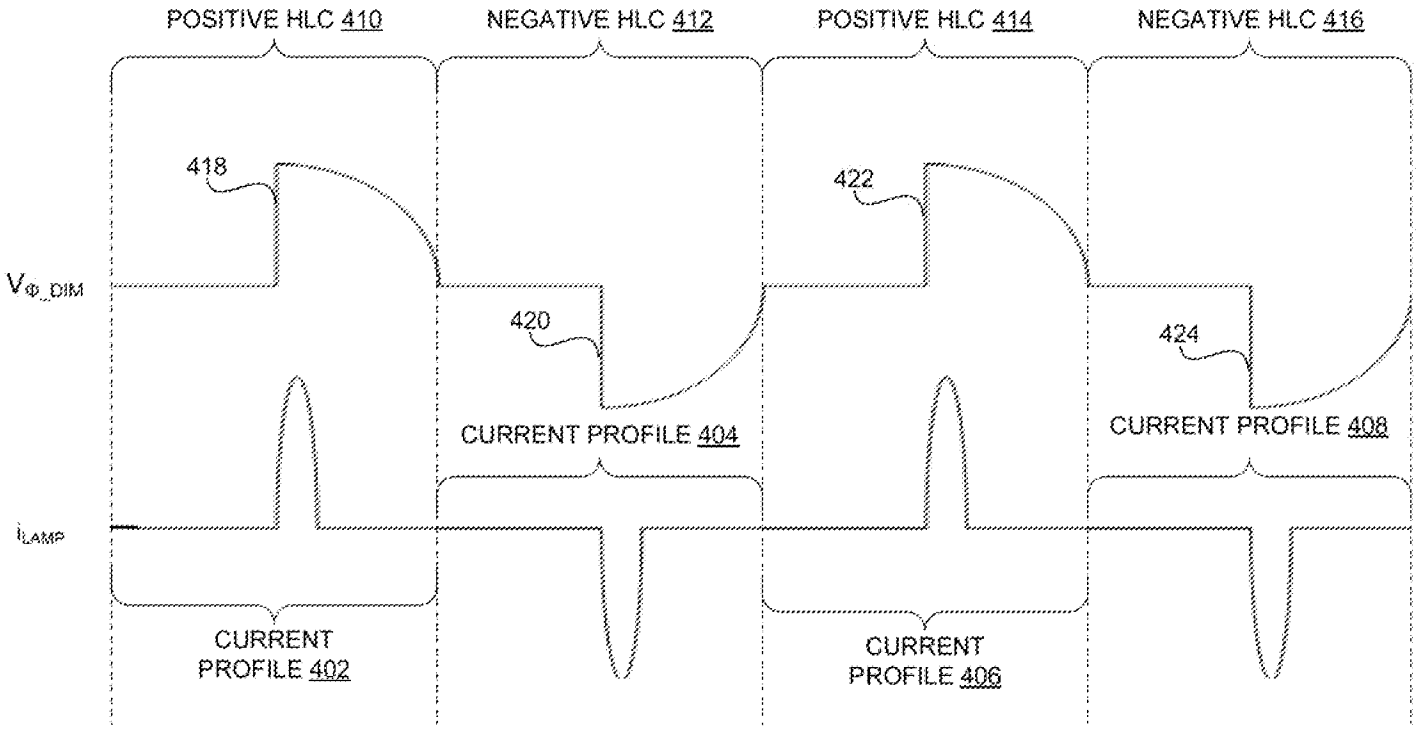
FIG. 4 (PRIOR ART)
FIG. 4 (labeled prior art) depicts exemplary voltage and current waveforms associated with the peak-rectified LED-based lamp of FIG. 3.
Figure 5:
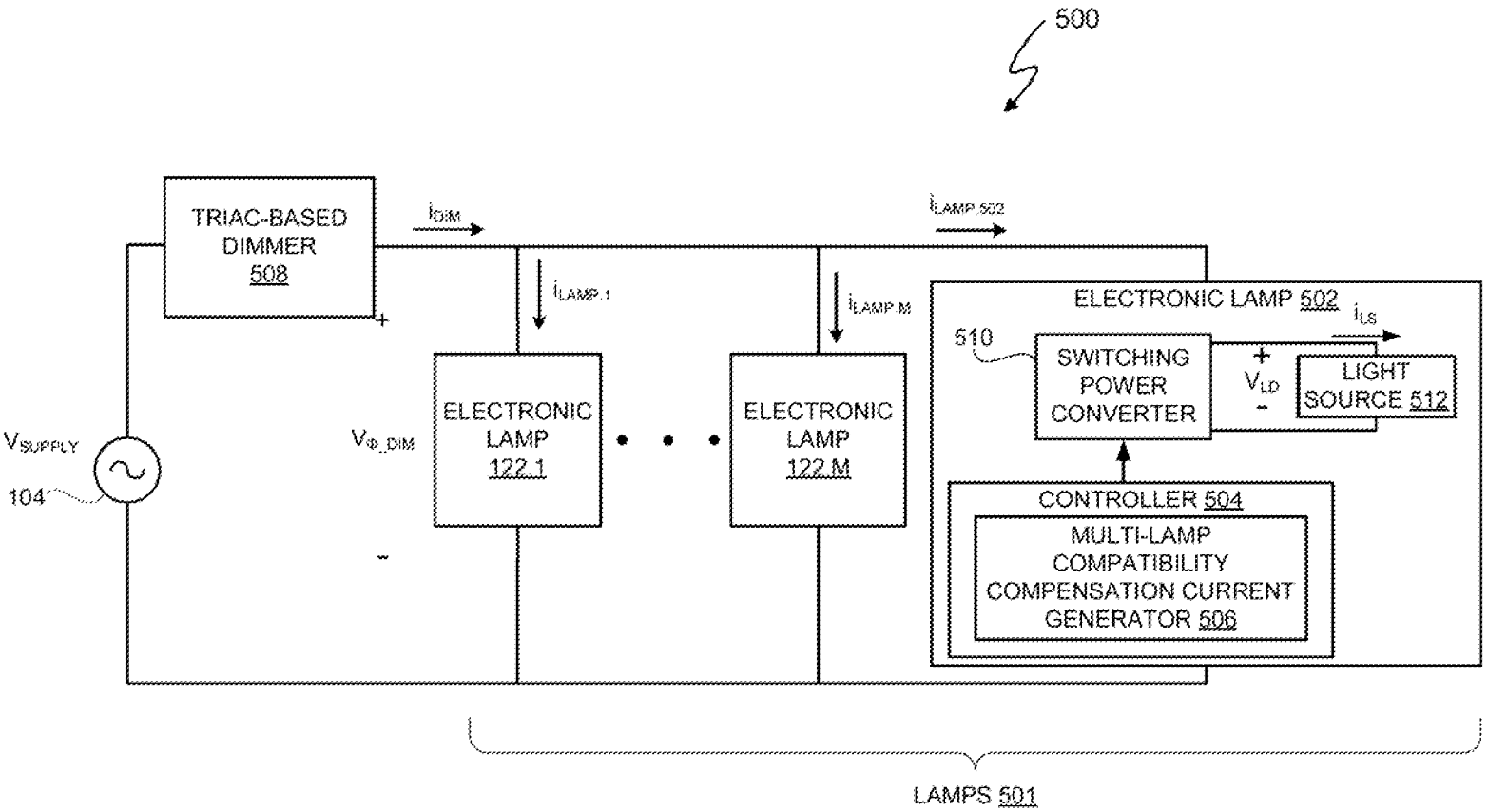
FIG. 5 depicts an exemplary lighting system that includes a mixed load of multiple, parallel configured LED-based lamps and an LED-based lamp that includes a controller with a multi-lamp compatibility compensation current generator.

FIG. 5 depicts an exemplary lighting system 500 that includes a mixed load of multiple, parallel configured lamp 501 including electronic lamps 122.1-122.M and an electronic lamp 502 that includes a controller 504 with a multi-lamp compatibility compensation current generator 506. Each of the lamps 122.1-122.M draws a respective lamp current $i_{LAMP.1}$ through $i_{LAMP.M}$. The values of the lamp current $i_{LAMP}$ over time represent a current profile of the lamp current $i_{LAMP}$. For example, as discussed in conjunction with FIG. 4, the current profiles of a peak-rectified LED-based lamp are of short duration relative to a half line cycle of the dimmer voltage $V_{\phi_DIM}$ and have a large positive and negative di/dt beginning at a leading edge of the dimmer voltage $V_{\phi_DIM}$. As previously mentioned and subsequently described in more detail, when the triac-based dimmer 508 phase cuts the supply voltage $V_{SUPPLY}$ from AC power supply 104 to generate the dimmer voltage $V_{_DIM}$, without current compensation, the current profiles of the lamps 501 and, in at least one embodiment, particularly current profiles of the electronic lamps 122.1-122.M with large di/dt's, can cause the dimmer current $i_{DIM}$ to fall below a holding current value of the triac based dimmer 508. Undershooting the holding current value problematically causes the dimmer 508 to prematurely stop conducting the dimmer current $i_{DIM}$. The compensation current generator 506 controls the lamp current $i_{LAMP_502}$ to prevent the dimmer current $i_{DIM}$ from undershooting the holding current value. Thus, the lamp 502 compensates for the lamp currents $i_{LAMP.1}$ through $i_{LAMP.M}$ to prevent premature non-conduction of a triac of the triac-based dimmer 508.

The controller 504 also controls the switching power converter 510 to provide an operating voltage $V_{LD}$ and a light source drive current $i_{LS}$ provided to the light source 512. The light source 512 can be any type of light source, such as one or more light emitting diodes (LEDs) or direct current light source type. The LED(s) can be any type(s) and color(s) of one or more LEDs. The type of switching power converter 510 is a matter of design choice and can be, for example, a two-stage or single state switching power converter with any combination of topologies, such as a boost, boost-buck, buck, and/or Ciik topology. The particular implementation of controller 504 is a matter of design choice. For example, controller 504 can be (i) implemented as an integrated circuit including, for example, a processor to execute software or firmware instructions stored in a memory, (ii) implemented using discrete components, or (iii) implemented using any combination of the foregoing. In at least one embodiment, controller 504 generally regulates the load voltage $V_{LD}$ as described in U.S. patent application Ser. No. 11/967,269, entitled "Power Control System Using a Nonlinear Delta-Sigma Modulator With Nonlinear Power Conversion Process Modeling", filed on Dec. 31, 2007, inventor John L. Melanson, U.S. patent application Ser. No. 11/967,275, entitled "Programmable Power Control System", filed on Dec. 31, 2007, and inventor John L. Melanson, U.S. patent application Ser. No. 12/495,457, entitled "Cascode Configured Switching Using at Least One Low Breakdown Voltage Internal, Integrated Circuit Switch to Control At Least One High Breakdown Voltage External Switch", filed on Jun. 30, 2009, and inventor John L. Melanson, and U.S. patent application Ser. No. 12/174,404, entitled "Constant Current Controller With Selectable Gain", filing date Jun. 30, 2011, and inventors John L. Melanson, Rahul Singh, and Siddharth Maru, which are all incorporated by reference in their entireties.

Figure 6:
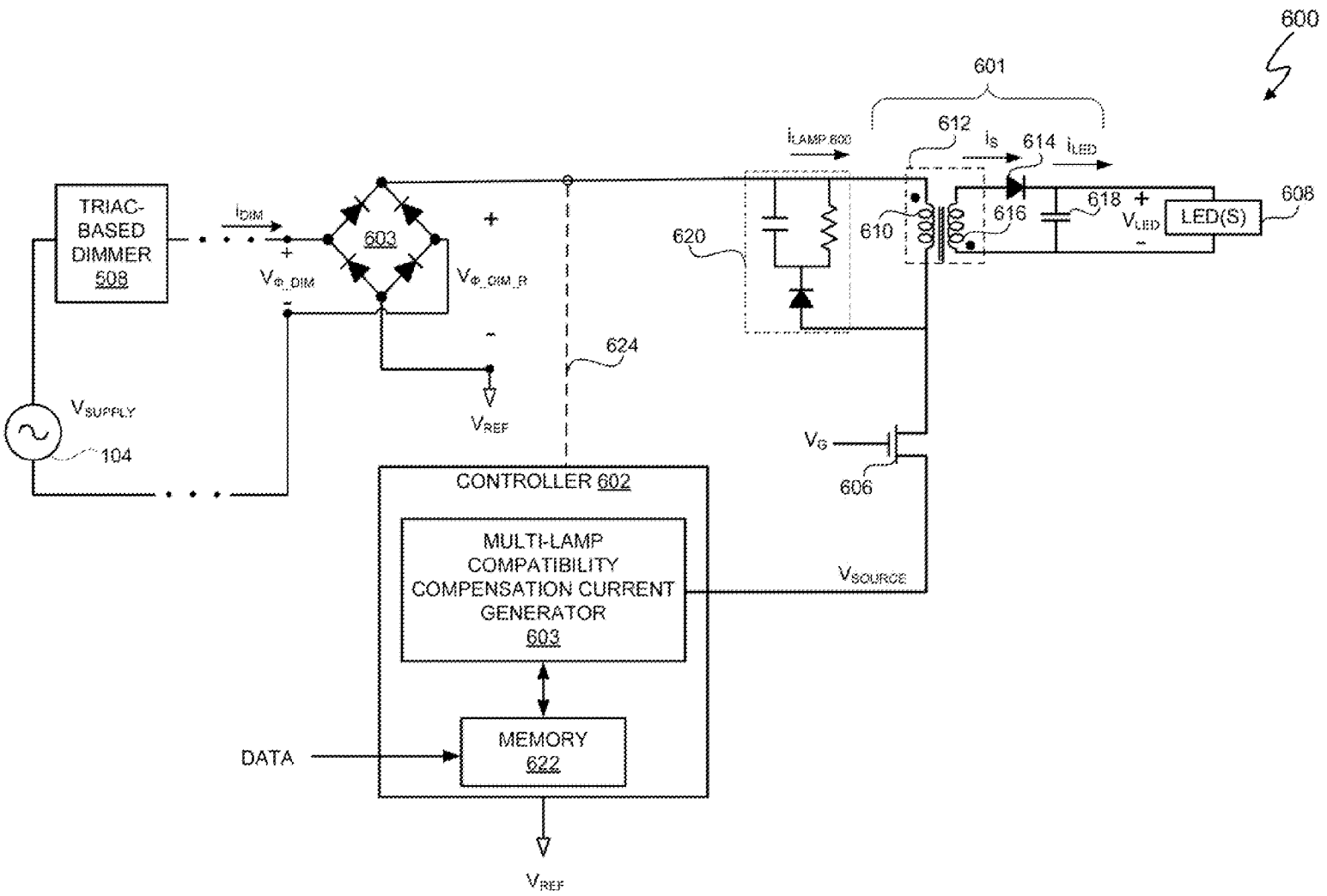
FIG. 6 depicts an LED-based lamp.

FIG. 6 depicts an LED-based lamp 600, which represents one embodiment of the lamp 502. As subsequently explained in more detail, the lamp 600 includes a controller 602 that includes a multi-lamp compatibility compensation current generator 603 to control the lamp current $i_{LAMP}$ to prevent the dimmer current $i_{DIM}$ through the dimmer 508 from undershooting a holding current value. The controller and the multi-lamp compatibility compensation current generator 603 represent respective embodiments of a controller 504 and the multi-lamp compatibility compensation current generator 506.

The lamp 600 utilizes a flyback-type switching power converter 601 to convert the dimmer voltage $V_{\phi_DIM}$ into an LED drive current $i_{LED}$ and load voltage $V_{LED}$ on the side of the secondary-winding 616 of the transformer 612. The lamp 600 includes a full-bridge, diode rectifier 603 to rectify the dimmer voltage $V_{\phi_DIM}$ to produce the rectified dimmer voltage $V_{\phi_DIM_R}$. The controller 602 provides source control to the source of the field effect transistor (FET) 606 to control the flyback-type, switching power converter 601 and, thus, control the lamp current $i_{LAMP.600}$, the LED drive current $i_{LED}$, and the load voltage $V_{LED}$. The values of the lamp current $i_{LAMP.600}$, the LED drive current $i_{LED}$, and the load voltage $V_{LED}$ correlate with the phase angle of the dimmer voltage $V_{\phi_DIM}$. The lighting system 600 includes LED(s) 608, which represent one embodiment of the light source 512. The brightness of the LED(s) 608 directly correlates with the value of the LED drive current $i_{LED}$. Thus, the brightness of the LED(s) 608 directly correlates with the phase angle of the dimmer voltage $V_{\phi_DIM}$.

The controller 602 controls the conductivity of the FET 606 to control the lamp current $i_{LAMP.600}$ to meet the power demands of LED(s) 608. For an n-channel FET, the FET 606 is biased with a fixed gate voltage $V_G$ and conducts (i.e. ON) when the source voltage $V_{SOURCE}$ is less than the gate voltage $V_G$ minus a threshold voltage of the FET 606 and is nonconductive (i.e. OFF) when the source voltage $V_{SOURCE}$ is greater than the gate voltage $V_G$ minus the threshold voltage. When the FET 606 conducts, the lamp current $i_{LAMP.600}$ ramps up through the primary winding 610 of transformer 612. The dot convention of transformer 612 and the diode 614 prevent flow of the LED current $i_{LED}$ from the secondary-winding 616 when FET 606 conducts and the lamp current $i_{LAMP.600}$ is flowing into the primary winding 610. When the controller 602 turns the FET 606 OFF, the lamp current $i_{LAMP.600}$ falls to 0, and the voltage across the primary winding 610 reverses for a period of time, referred to as the "flyback time". During the flyback time, the secondary current $i_s$ quickly rises and charges capacitor 618. Capacitor 618 provides an output voltage $V_{LED}$ and current $i_{LED}$ to the LED(s) 608. A diode and resistor-capacitor filter circuit 620 provides a path for voltage perturbations. An exemplary flyback-type switching power converter and corresponding control and auxiliary power supply is described in U.S. patent application Ser. No. 13/715,451, entitled "Isolation of Secondary Transformer Winding Current During Auxiliary Power Supply Generation", inventors John L. Melanson, Prashanth Drakshapalli, and Siddharth Maru, filing date Dec. 14, 2012, which is incorporated by reference in its entirety. As subsequently described in more detail, in at least one embodiment, the controller 602 also includes a non-transitory memory 622 that stores code that is executable by the compensation current generator 603 as a state machine to control the dimmer current $i_{DIM}$ to prevent the dimmer current $i_{DIM}$ from undershooting the holding current value. In at least one embodiment, the memory 622 receives the code from an external DATA programming signal. In at least one embodiment, the code is prestored in the memory 622. In at least one embodiment, the memory 622 is replaced with circuitry that implements the state machine. In at least one embodiment, the controller 602 senses the rectified dimmer voltage $V_{\phi_DIM_R}$ via a sense path 624 to determine when to control the lamp current $i_{LAMP.600}$ by, for example, generating a current pulse to prevent a possible undershoot of the holding current value by the dimmer current $i_{DIM}$.

Figure 7:
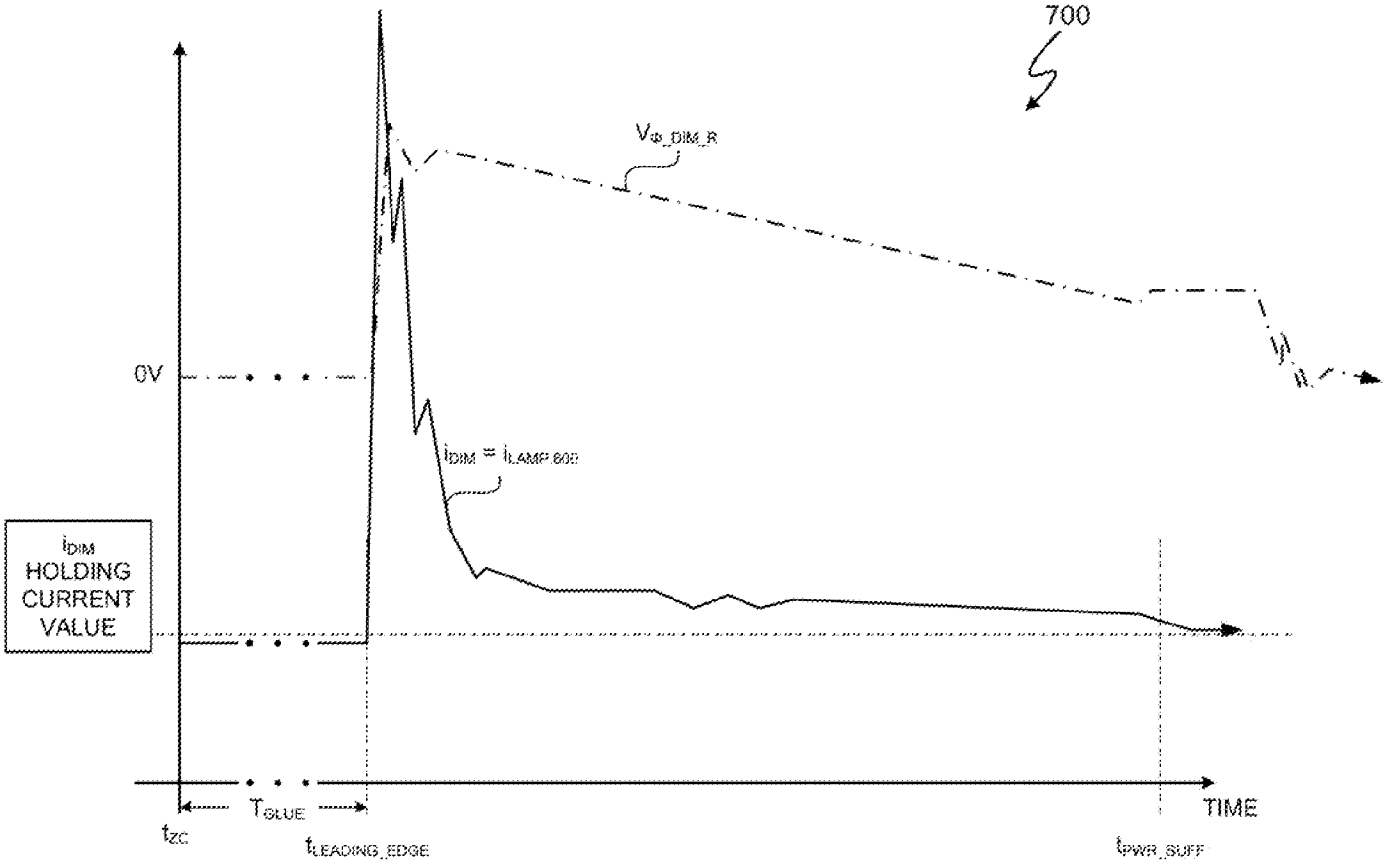
FIG. 7 depicts exemplary, superimposed waveforms of a dimmer voltage and lamp current when the lamp of FIG. 6 is the only lamp present in the lighting system of FIG. 5.

FIG. 7 depicts exemplary, superimposed waveforms 700 of the dimmer voltage $V_{\phi_DIM}$ and the lamp current $i_{LAMP.600}$ when lamp 600, an embodiment of electronic lamp 502, is the only lamp present in the lighting system 500. When the lamp 600 is the only lamp present in the lighting system 500, the lamp current $i_{LAMP.600}$ equals the dimmer current $i_{DIM}$. At the zero crossing time $t_{ZC}$, which indicates a beginning of a new cycle of the dimmer voltage $V_{\phi_DIM}$, the controller 602 optionally asserts a "glue" current during the glue period $T_{GLUE}$ to keep the dimmer 508 from conducting until the timer circuit of dimmer 508 causes the triac of the dimmer 508 to conduct. Exemplary embodiments of asserting the glue current are described in U.S. patent application Ser. No. 12/858,164, entitled "DIMMER OUTPUT EMULATION", inventor John L. Melanson and U.S. patent application Ser. No. 13/290,032, entitled "Switching Power Converter Input Voltage Approximate Zero Crossing Determination", filing date Nov. 4, 2011, and inventors Eric J. King and John L. Melanson, which are both incorporated by reference in their entireties.

When the leading edge of the dimmer voltage $V_{\phi_DIM}$ occurs at the time $t_{LEADING_EDGE}$, the controller 602 causes the lamp current $i_{LAMP.600}$ to rise above the holding current value of the dimmer current $i_{DIM}$. The lamp current $i_{LAMP.600}$ rises and then falls as the switching power converter 601 energizes the primary coil 610 to provide sufficient power to the LED(s) 608. The controller 602 maintains the lamp current $i_{LAMP.600}$ above the holding current value until the time $t_{PWR_SUFF}$ when the switching power converter has drawn sufficient power during the cycle of the dimmer voltage $V_{\phi_DIM}$ for the LED(s) 608 to illuminate at the brightness indicated by the phase angle of the dimmer voltage $V_{\phi_DIM}$. The rectified dimmer voltage $V_{\phi_DIM_R}$ momentarily rises when the lamp current $i_{LAMP.600}$ falls to just above the holding current value.

Figure 8:
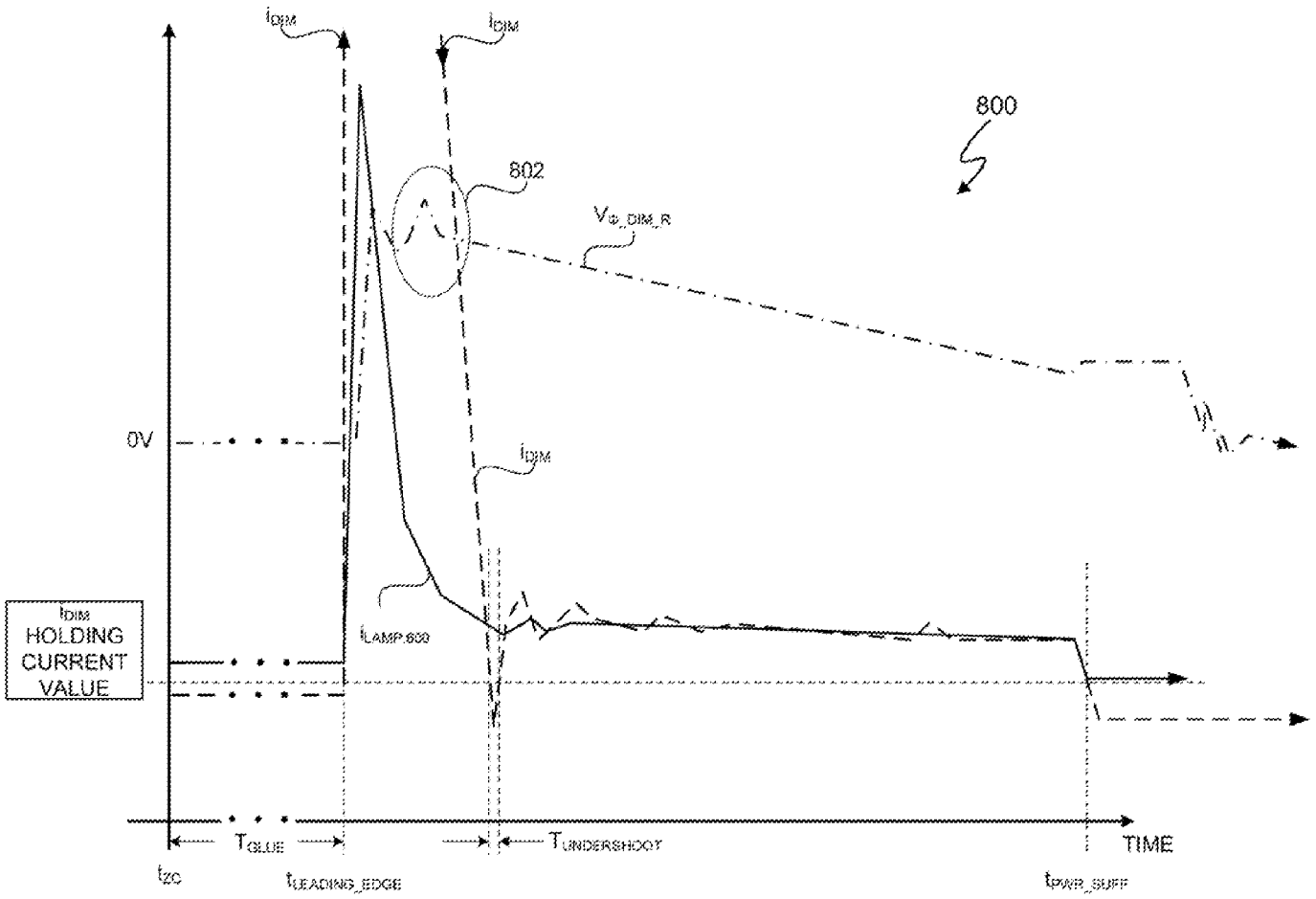
FIG. 8 depicts exemplary, superimposed waveforms of a dimmer voltage and lamp currents with a mixed set of lamps including the lamp of FIG. 6.

FIG. 8 depicts exemplary, superimposed waveforms 800 of the dimmer voltage $V_{\phi_DIM}$ and the lamp current $i_{LAMP.600}$ when multiple, peak-rectified lamps 122.1-122.M (where M equals, for example, 3), and lamp 600 are present in the lighting system 500. The waveforms 800 represent an absence of compensation current by the compensation current generator 603 (FIG. 6). The dimmer current $i_{DIM}$ represents the sum of the lamp currents into lamps 122.1-122.M and lamp 600 (FIGS. 5 and 6). At the leading edge time $t_{LEADING_EDGE}$, the dimmer current $i_{DIM}$ rapidly climbs to a peak value that exceeds the scale of FIG. 8. The lamp current $i_{LAMP.600}$ has a smaller di/dt and draws current through the dimmer 508 for a longer period of time than the peak-rectified lamps 122.1-122.M. However, because of the large di/dt of the dimmer current $i_{DIM}$ due to the mixed load of lamps and without current compensation from the compensation current generator 603, the dimmer current $i_{DIM}$ undershoots the holding current value during the period $T_{UNDERSHOOT}$. At the end of the period $T_{UNDERSHOOT}$, the peak-rectified lamps 122.1-122.M stop drawing current, and the dimmer current $i_{DIM}$ approximately tracks the lamp current $i_{LAMP.600}$. When the dimmer current $i_{DIM}$ undershoots below the holding current value, one or more of the lamps 122.1-122.M and lamp 600 can exhibit non-ideal behavior such as flicker and shortened efficacy.

As subsequently described in more detail, in at least one embodiment, the compensation current generator 603 determines when to control the lamp current $i_{LAMP.600}$ to prevent an undershoot of the holding value by the dimmer current $i_{DIM}$ by dynamically sensing an indication of the possibility of the undershoot. When the dimmer current $i_{DIM}$ decreases, such as when one or more of the lamps 122.1-122.M stop drawing current, the rectified dimmer voltage $V_{\phi_DIM_R}$ abruptly changes, as illustratively shown in the identified portion 802 of the rectified dimmer voltage $V_{\phi_DIM_R}$. Thus, in at least one embodiment, the compensation current generator 603 senses the rectified dimmer voltage $V_{\phi_DIM_R}$ to identify the changing portion 802 of the rectified dimmer voltage $V_{100_DIM_R}$ and controls the lamp current $i_{LAMP.600}$ to compensate for the falling dimmer current $i_{DIM}$ to prevent an undershoot of the holding current value. The changing portion 802 is shown as a rise in the rectified dimmer voltage $V_{\phi_DIM_R}$ in this positive half-cycle of the rectified dimmer voltage $V_{\phi_DIM_R}$. A corresponding portion in a negative half-cycle of the rectified dimmer voltage $V_{\phi_DIM_R}$ is an abrupt decrease in the rectified dimmer voltage $V_{\phi_DIM_R}$.

Figure 9:
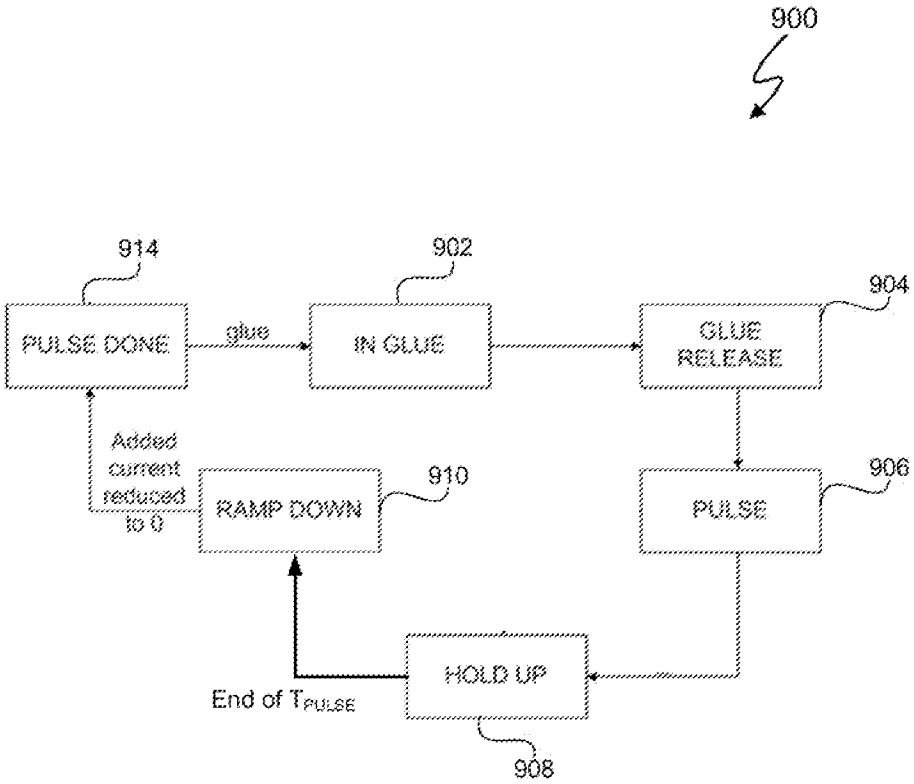
FIG. 9 depicts an exemplary state machine to provide current compensation for the mixed set of lamps in the lighting system of FIG. 5.

FIG. 9 depicts an exemplary state machine 900 to provide current compensation for the mixed set of lamps in the lighting system 500 and, thus, control the lamp current $i_{LAMP.600}$ to prevent the dimmer current $i_{DIM}$ from undershooting the holding current value. Referring to FIG. 6, in at least one embodiment, the memory 622 stores the state machine 900 as code that is executable by a processor of the compensation current generator 603.

Figure 10:
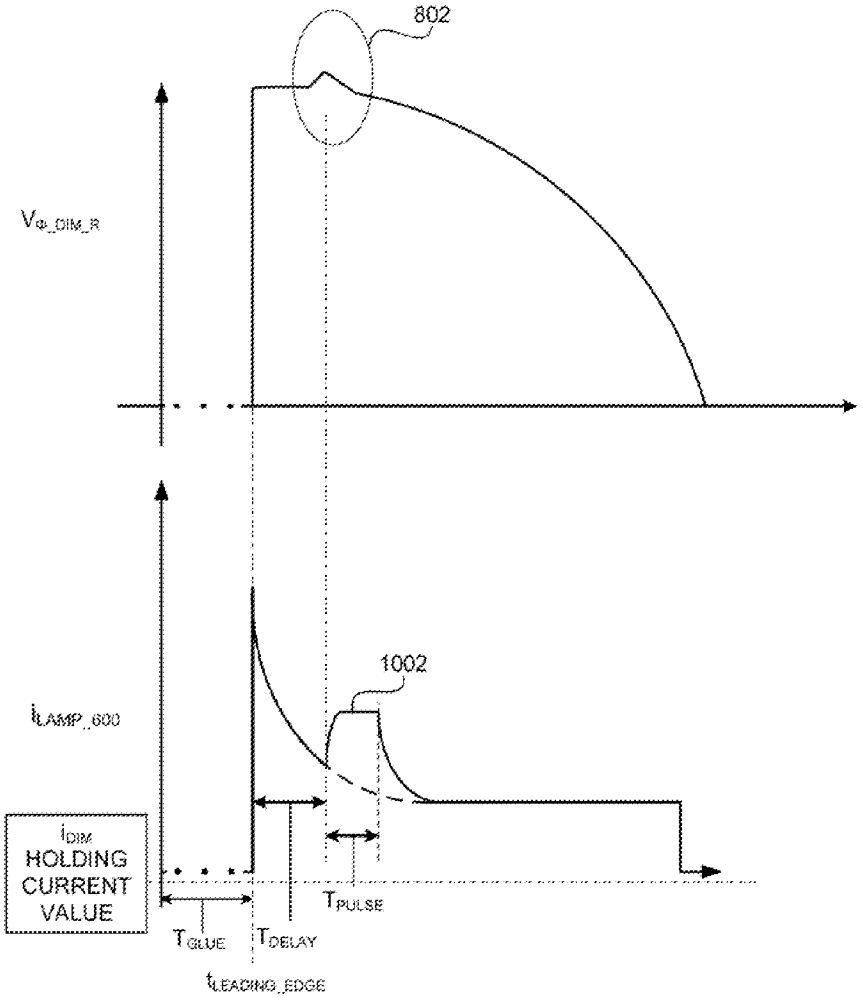
FIG. 10 depicts exemplary dimmer voltage and lamp current waveforms when a compensation current generator of the lamp of FIG. 6 controls the lamp current.

FIG. 10 depicts exemplary dimmer voltage $V_{\phi_DIM}$ and lamp current $i_{LAMP.600}$ waveforms 1000 when the compensation current generator 603 controls the lamp current $i_{LAMP.600}$ to prevent the dimmer current $i_{DIM}$ from undershooting the holding current value. Referring to FIGS. 6, 9, and 10, in the IN GLUE state 902, the controller 602 controls the lamp current $i_{LAMP.600}$ as a glue current during the glue period $T_{GLUE}$. At the occurrence of the leading edge at time $t_{LEADING_EDGE}$, the GLUE RELEASE state 904 releases the glue signal, and the controller 602 causes the lamp current $i_{LAMP.600}$ to quickly rise. In at least one embodiment, the state machine 900 then waits for a delay period $T_{DELAY}$ before causing an assertion of a current compensation pulse 1002 of the lamp current $i_{LAMP.600}$ during the period $T_{PULSE}$. The delay period $T_{DELAY}$ corresponds to a time period when the dimmer current $i_{DIM}$ would otherwise undershoot the holding current value. At the end of the delay period state PULSE 906 causes the compensation current generator 603 to generate a pulse of the lamp current $i_{LAMP.600}$. In at least one embodiment, the state machine 900 waits for a dynamic determination of an event that predicts a possibility of an undershoot of the holding current value by the dimmer current $i_{DIM}$ through a triac of the dimmer 508 (FIG. 5).

Since the dimmer current $i_{DIM}$ is a superposition of the lamp currents $i_{LAMP.1}$ through $i_{LAMP.M}$ and lamp current $i_{LAMP.600}$, generating the current compensation pulse 1002 in the lamp current $i_{LAMP.600}$ correspondingly increases the value of the dimmer current $i_{DIM}$. Since the state machine 1000 times the current compensation pulse 1002 to occur when the dimmer current $i_{DIM}$ would otherwise undershoot the holding current value, the compensation current generator 603 controls the lamp current $i_{LAMP.600}$ to prevent the dimmer current $i_{DIM}$ from undershooting the holding value. HOLD UP state 908 causes the compensation current generator 603 to maintain the current compensation pulse 1002 of the lamp current $i_{LAMP.600}$ until the end to the pulse period $T_{PULSE}$. In at least one embodiment, the duration of the pulse period $T_{PULSE}$ is empirically determined to correspond to the duration of the time during which an undershoot of the dimmer current $i_{DIM}$ below the holding current value would otherwise occur. In at least one embodiment, both the delay period $T_{DELAY}$ and the pulse period $T_{PULSE}$ are extended by a margin of error based on the maximum empirically determined delay period and pulse period. In at least one embodiment, at the end of the pulse period $T_{PULSE}$, state RAMP DOWN 910 ramps down the current compensation pulse 1002 at a di/dt rate that does not cause the dimmer current $i_{DIM}$ to drop below the holding current value and also minimizes other potential perturbations of the dimmer voltage $V_{\phi_DIM}$. At the end of the state RAMP DOWN 910, the current compensation pulse 1002 is finished as indicated by state PULSE DONE 914. The state machine 900 then repeats for the next cycle of the dimmer voltage $V_{\phi_DIM}$.

In at least one embodiment, assertion of the current compensation pulse 1002 draws more dimmer current $i_{DIM}$ than is used to drive the LED(s) 608. In at least one embodiment, the controller 602 dissipates excess power associated with the excess current. The particular manner of dissipation is a matter of design choice, such as routing the excess current through a resistor or dissipating the excess current in the FET 606. Exemplary systems and method for dissipating excess power are described in U.S. patent application Ser. No. 13/289,845, entitled "Controlled Energy Dissipation in a Switching Power Converter", filed Nov. 4, 2011, and inventors John L. Melanson and Eric. J. King and in U.S. patent application Ser. No. 13/289,931, entitled "Controlled Power Dissipation in a Lighting System", filed Nov. 4, 2011, and inventors John L. Melanson and Eric. J. King. U.S. patent application Ser. No. 13/289,845 and U.S. patent application Ser. No. 13/289,931 are both incorporated by reference herein in their entireties.

Figure 11:
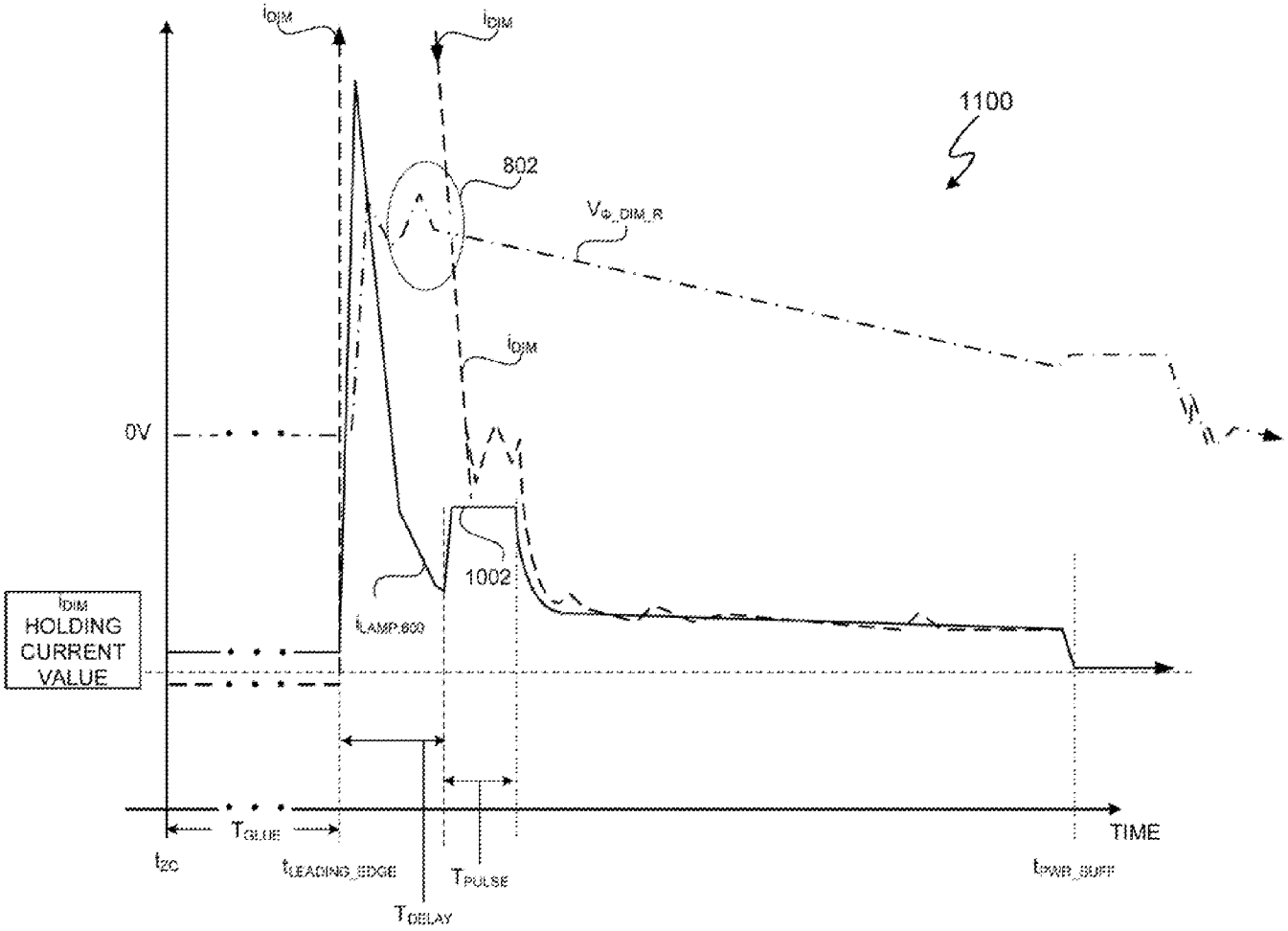
FIG. 11 depicts exemplary, superimposed waveforms of a dimmer voltage and lamp current when multiple, peak-rectified lamps and the lamp of FIG. 6 are present in the lighting system of FIG. 5.

FIG. 11 depicts exemplary, superimposed waveforms 1100 of the dimmer voltage $V_{\phi_DIM}$ and the lamp current $i_{LAMP.600}$ when multiple, peak-rectified lamps 122.1-122.M (where M equals, for example, 3), and lamp 600 are present in the lighting system 500. The waveforms 1100 represent the presence of the current compensation pulse 1002 by the compensation current generator 603 as described in conjunction with the FIGS. 6, 9, and 10.

Figure 12:
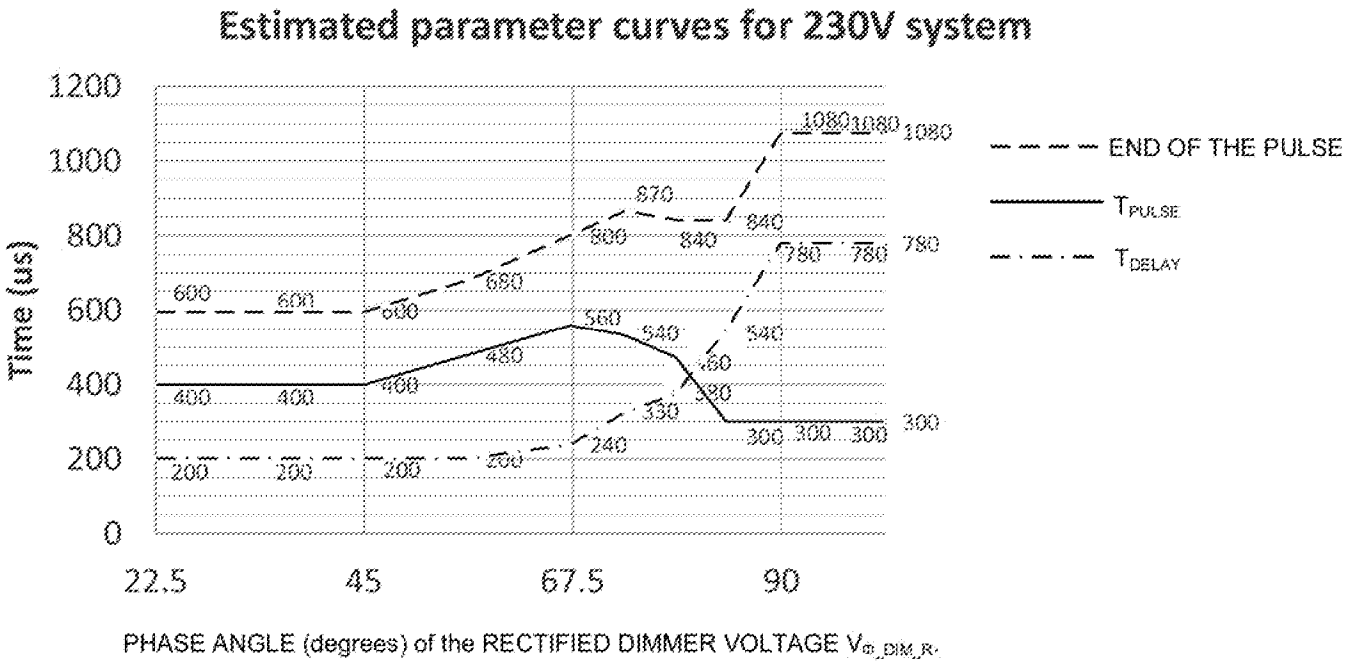
FIG. 12 depicts exemplary delay period data, pulse period data, and the end of the pulse data corresponding to various phase-cut angles for a nominal 230V supply voltage.

FIG. 12 depicts exemplary delay period $T_{DELAY}$ data, pulse period $T_{PULSE}$ data, and the end of the pulse data corresponding to various phase-cut angles for a nominal 230V supply voltage $V_{SUPPLY}$. The end of the pulse data equals the sum of the period $T_{DELAY}$ plus the period $T_{PULSE}$. In at least one embodiment, the value of the delay period $T_{DELAY}$ in FIG. 12 is empirically determined based on the particular characteristics of the lamps 122.1-122.M of the lighting system 500 (FIG. 5). In at least one embodiment, as shown in FIG. 12, the particular values of the pulse period $T_{PULSE}$ and the delay period $T_{DELAY}$ are dependent on the phase angle of the rectified dimmer voltage $V_{\phi_DIM_R}$. In at least one embodiment, the data represented in FIG. 12 is stored in the memory 622 of the controller 602 (FIG. 6). In at least one embodiment, the pulse period $T_{PULSE}$ and the delay period $T_{DELAY}$ are non-linear with respect to the phase angles of the rectified dimmer voltage $V_{\phi_DIM_R}$.

Figure 13:
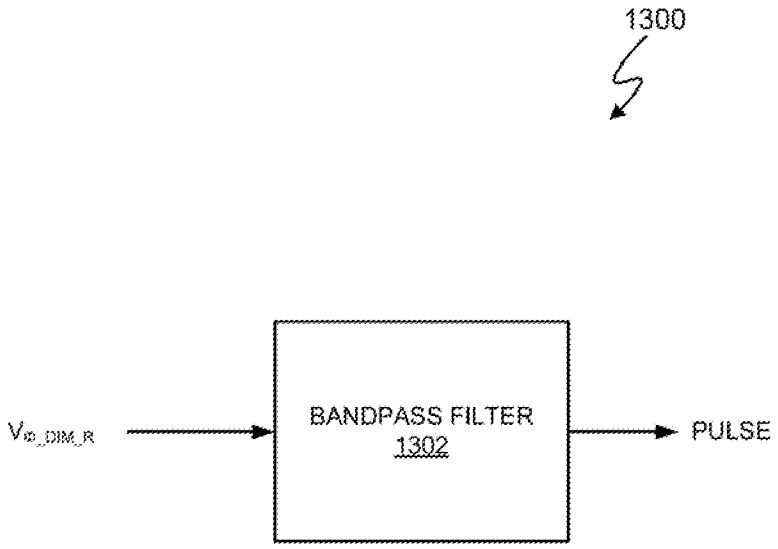
FIG. 13 depicts a compensation current initiator.

FIG. 13 depicts a compensation current initiator 1300, which, in at least one embodiment, is part of the compensation current generator 603. In at least one embodiment, the exemplary changing portion 802 (FIG. 8) of the rectified dimmer voltage $V_{\phi_DIM_R}$ is characterized by a sharp change, which correlates to a frequency component of the rectified dimmer voltage $V_{\phi_DIM_R}$. The bandpass filter 1302 receives a sensed version of the rectified dimmer voltage $V_{\phi_DIM_R}$. The sensed version of the rectified dimmer voltage $V_{\phi_DIM_R}$ is, for example, either a sampled, digital version or an analog version. The frequency band of the bandpass filter 1302 is a matter of design choice and, in at least one embodiment, is designed to ignore low and high frequency perturbations of the rectified dimmer voltage $V_{\phi_DIM_R}$ that are not associated with a potential for an undershoot of the holding current value. An example frequency pass band is 1kHz to 100kHz. If the bandpass filter 1302 detects a frequency component of the rectified dimmer voltage $V_{\phi_DIM_R}$ in the frequency pass band, the bandpass filter 1302 generates a PULSE signal that causes the state machine 900 (FIG. 9) to transition from the GLUE RELEASE state 904 to the PULSE state 906.

Numerous other processes can be used by the compensation current generator 603 and the state machine 900 to determine when to transition from the GLUE RELEASE state 904 to the PULSE state 906 in addition to the empirically determined $T_{DELAY}$ and the dynamic determination of a potential for an undershoot of the holding current value. The particular process is a matter of design choice. For example, in at least one embodiment, a prior sample of the dimmer current $i_{DIM}$ during a cycle of the rectified dimmer voltage $V_{\phi_DIM_R}$ and determination of when an undershoot occurred can be used by the compensation current generator 603 and the state machine 900 as the delay time for the current and/or one or more subsequent cycles of the rectified dimmer voltage $V_{\phi_DIM_R}$ to transition from the GLUE RELEASE state 904 to the PULSE state 906. The particular duration of the delay time is a matter of design choice and is, in at least one embodiment, chosen with a minimum duration sufficient to prevent the undershoot of the holding current by the current through a triac (as, for example, shown in FIG. 1) of the triac-based dimmer 508.

Figure 14:
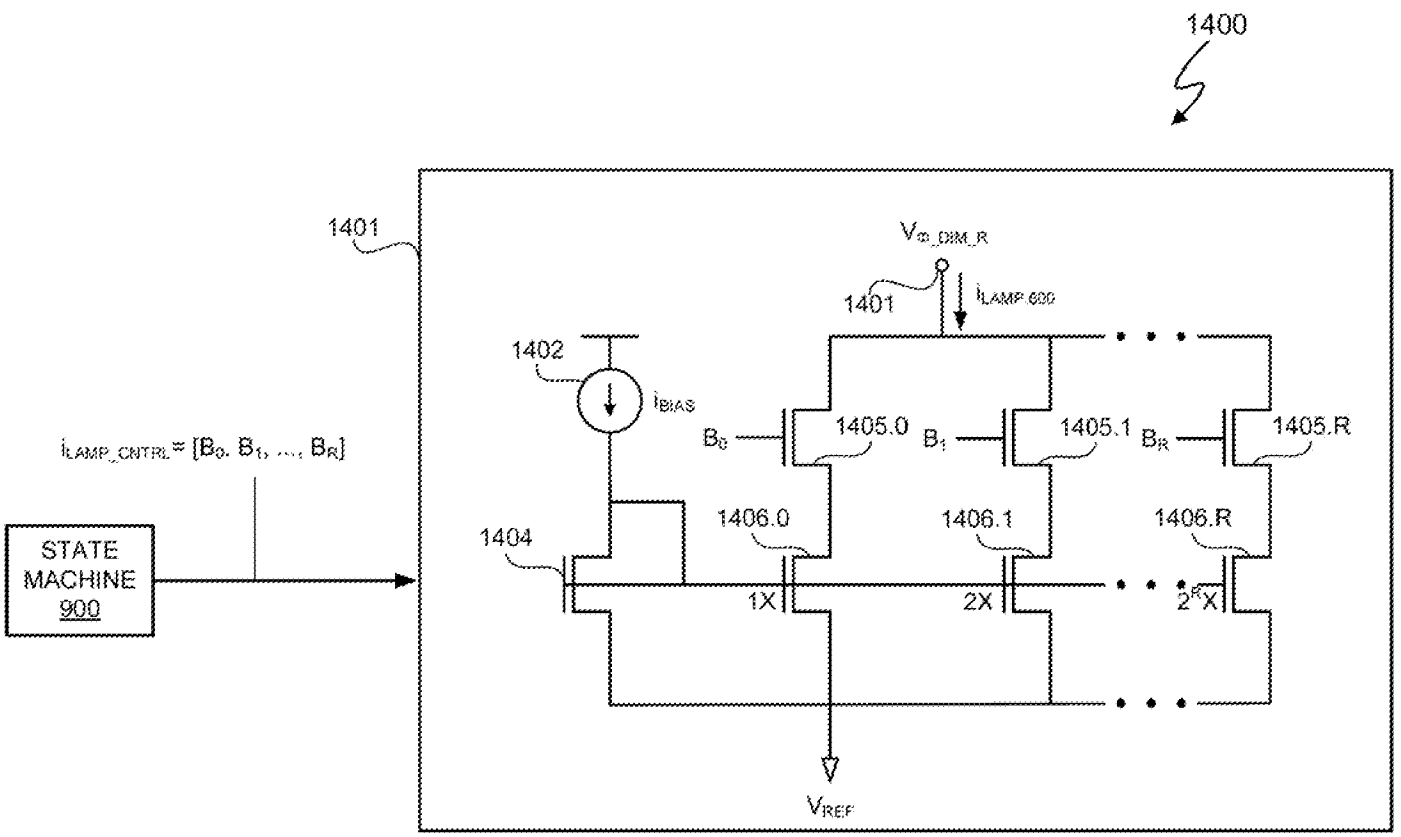
FIG. 14 depicts an exemplary multi-lamp compatibility compensation current generator.

FIG. 14 depicts an exemplary multi-lamp compatibility compensation current generator 1400, which represents one embodiment of the multi-lamp compatibility compensation current generator 603. To control the lamp current $i_{LAMP.600}$, the state machine 900 controls a digital current control value $i_{LAMP_CNTRL}$. The current control value $i_{LAMP_CNTRL}$ is an R+1 bit signal having bits $[B_0, B_1, \ldots, B_R]$, and R is a positive integer, such as 4, 8, or 16. The digital current control value $i_{LAMP_CNTRL}$ is an input to a current source 1401, which controls the value of the dimmer current $i_{\phi_R}$.

During operation, current source 1401 sources current from source voltage node 407 and provides a variable impedance path for the lamp current $i_{LAMP.600}$ to control the value of the lamp current $i_{LAMP.600}$. Current source 1401 includes a bias current source 1402 that generates a bias current $i_{BIAS}$. A drain and gate of FET 1404 are connected together to form a "diode connected" configuration. The R+1 series connected FET pairs 1405.0/1406.0 through 1405.N/1406.N are respectively configured in a current mirror arrangement with FET 1404 to mirror the bias current $i_{BIAS}$. "R" is an integer, and the value of R is a matter of design choice. Each pair of FETs 1405.X/1406.X is sized so that each subsequent pair sources twice as much current as the previous pair, e.g. FET pair 1405.1/1406.1 sources twice as much current as FET pair 1405.0/1406.0, and so on. "X" is an integer index ranging from 0 to R. In at least one embodiment, the value of R determines a maximum level of current capable of being sourced through current source 1401.

In at least one embodiment, the variable impedance control signal I_VAR is a digital value having R+1 bits, i.e. I_VAR= $[B_0, B_1, \ldots, B_R]$. Each bit $B_0, B_1, \ldots, B_R$ is applied to the gate of a respective FET pair 1405.0/1406.0, 1405.1/1406.1, . . . , 1405.R/1406.R to control conductivity of the FET pairs. To operate the current source 1401, the state machine 900 sets a logical value of $i_{LAMP_CNTRL}$ to set bits $[B_0, B_1, \ldots, B_R]$. For example, to turn all of the FET pairs ON, state machine 900 sets $[B_0, B_1, \ldots, B_R]=[1, 1, \ldots, 1]$ to cause each FET pair 1405.0/1406.0, 1405.1/1406.1, . . . , 1405.R/1406.R to conduct and sets bits to a logical value of I_VAR to $B_0, B_1, \ldots, B_R=[0, 0, \ldots, 0]$ to cause each FET pair 1405.0/1406.0, 1405.1/1406.1, . . . , 1405.R/1406.R to turn "off", i.e. non-conductive. In at least one embodiment, the state machine 900 sets the value of bits $[B_0, B_1, \ldots, B_R]$ so that the lamp current $i_{LAMP.600}$ follows the current profile of FIGS. 10 and 11 in accordance with the delay period $T_{DELAY}$ and the pulse period $T_{PULSE}$ of FIG. 12.

Figure 15:
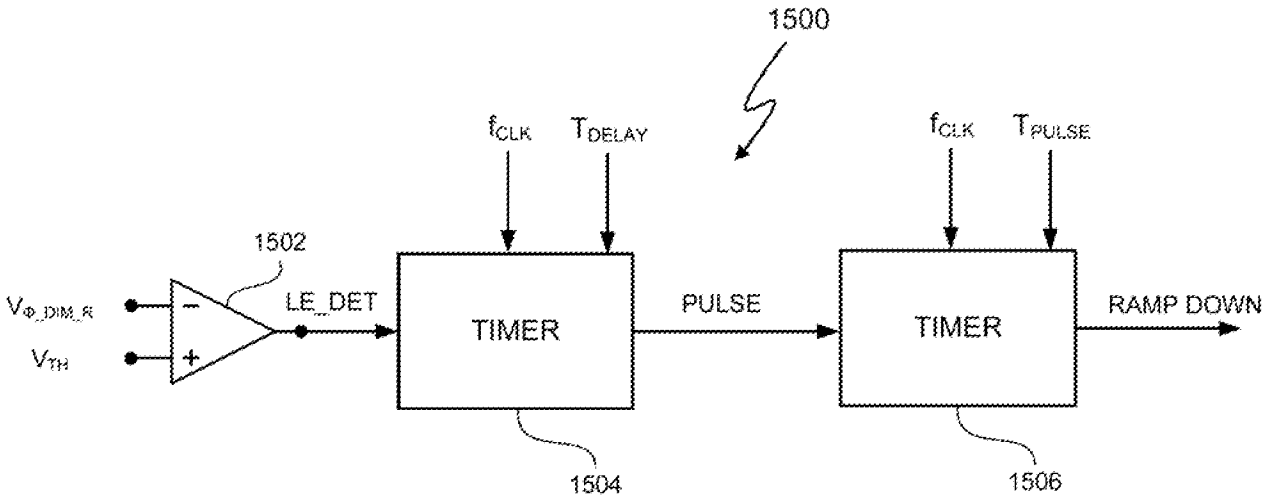
FIG. 15 depicts an exemplary leading edge detector and state controller.

FIG. 15 depicts an exemplary leading edge detector and state controller 1500 of the controller 602 to detect leading edges of the dimmer voltage $V_{\phi_DIM}$. Comparator 1502 compares the rectified dimmer voltage $V_{\phi_DIM_R}$ to a threshold voltage $V_{TH}$. In at least one embodiment, the threshold voltage $V_{TH}$ is greater than 0V and is sufficient to allow the leading edge detector 1500 to detect the leading edge of the rectified dimmer voltage $V_{\phi_DIM_R}$ without being affected by minor perturbations of the rectified dimmer voltage $V_{\phi_DIM_R}$ prior to an occurrence of a leading edge. When the rectified dimmer voltage $V_{\phi_DIM_R}$ exceeds the threshold voltage $V_{TH}$, comparator 1502 changes the logical value of output signal LE_DET from a logical zero to a logical one to indicate detection of a leading edge. The timer 1504 begins timing a duration from detection of the leading edge of the rectified dimmer voltage $V_{\phi_DIM_R}$ until the value of the delay period $T_{DELAY}$ is reached. When the delay period $T_{DELAY}$ time is reached, the timer generates a PULSE signal which causes the state machine 900 and, thus, the compensation current generator to control the lamp current $i_{LAMP.600}$ to generate the current compensation pulse 1002 (FIG. 10). The timer 1506 determines when the duration of the current compensation pulse 1002 reaches the pulse period $T_{PULSE}$ value. When the duration of the current compensation pulse 1002 reaches the pulse period $T_{PULSE}$ value, the timer 1506 generates a RAMP DOWN signal to cause the compensation current generator to ramp down the lamp current $i_{LAMP.600}$ as, for example, depicted in FIGS. 10 and 11.

Thus, a system and method provide current compensation in a lighting system by controlling a lamp current to prevent a current through a dimmer from undershooting a holding current value.

Although embodiments have been described in detail, it should be understood that various changes, substitutions, and alterations can be made hereto without departing from the spirit and scope of the invention as defined by the appended claims.

What is claimed is:

1. A method comprising:

detecting a leading edge of a dimmer phase-cut voltage;

after detecting the leading edge, controlling a lamp current of an electronic lamp to prevent a current through a triac of the dimmer from undershooting a holding current value, wherein the holding current value represents a value that if undershot by the current through the triac of the dimmer would stop the triac from conducting, wherein controlling the lamp current of the electronic lamp to prevent the current through the triac of the dimmer from undershooting the holding current value includes:

responding to an increase in the dimmer phase-cut voltage after detection of the leading edge that would otherwise cause the current through the triac to undershoot the holding current value by causing a generation of a compensating current that increases the lamp current and prevents the current through the triac from undershooting the holding current value.

2. The method of claim 1 wherein controlling a lamp current to prevent a current through the dimmer from undershooting a holding current value comprises:

generating the compensating current as a current pulse for a first duration of time as the current through the dimmer decreases.

3. The method of claim 2 wherein a lighting system includes multiple lamps including the electronic lamp coupled in parallel to receive a portion of the lamp current and wherein the first duration of time is based on current control characteristics of at least a plurality of the multiple lamps.

4. The method of claim 2 further comprising:

retrieving data from a memory in a controller of a switching power converter, wherein the data represents the first duration of time of the current pulse.

5. The method of claim 2 further comprising:

ramping down the current pulse at the end of the first duration of time.

6. The method of claim 1 wherein controlling a lamp current to prevent a current through a triac of the dimmer from undershooting a holding current value draws an amount of excess current into a switching power converter of the electronic lamp, wherein the amount of excess current is an amount of current that exceeds an amount of current used to illuminate a light source of the electronic lamp at a brightness corresponding to the dimmer phase-cut voltage, the method further comprising:

dissipating power in the switching power converter that corresponds to the amount of excess current drawn.

7. The method of claim 1 wherein controlling a lamp current to prevent a current through the dimmer from undershooting a holding current value further comprises:

varying an amount of lamp current drawn to prevent the undershooting in correlation with different phase-cut angles of the dimmer phase-cut voltage.

8. The method of claim 7 wherein variations of the amount of lamp current drawn to prevent the undershooting for difference phase-cut angles of the dimmer phase-cut voltage are non-linear with respect to the phase-cut angles of the dimmer phase-cur angle.

9. The method of claim 1 wherein controlling a lamp current to prevent a current through the dimmer from undershooting a holding current value comprises:

superimposing the lamp current on the current through the dimmer to prevent the current through the dimmer from undershooting the holding current value.

10. The method of claim 1 further comprising:

waiting for a first duration of time after detecting the leading edge before controlling the lamp current to prevent the current through the dimmer from undershooting the holding current value.

11. The method of claim 10 wherein the first duration of time after detecting the leading edge begins after the current through the dimmer has a negative change over time and before the current through the dimmer reaches the holding current value.

12. The method of claim 1 wherein the dimmer is a triac-based dimmer that conducts current provided to a non-homogenous set of light emitting diode-based lamps.

13. The method of claim 1 wherein responding to an increase in the dimmer phase-cut voltage after detection of the leading edge that would otherwise cause the current through the triac to undershoot the holding current value by causing a generation of a compensating current further comprises:

dynamically detecting an indication of a possible undershoot of the holding current value; and upon detection of the indication, controlling the lamp current to prevent the current through a triac of the dimmer from undershooting the holding current value.

14. The method of claim 1 wherein the electronic lamp comprises one or more light emitting diodes.

15. An apparatus comprising:

a controller, wherein the controller is configured to:

detect a leading edge of a dimmer phase-cut voltage;

after detecting the leading edge, control a lamp current of an electronic lamp to prevent a current through a triac of the dimmer from undershooting a holding current value, wherein the holding current value represents a value that if undershot by the current through the triac of the dimmer would stop the triac from conducting, wherein to the lamp current of the electronic lamp to prevent the current through the triac of the dimmer from undershooting the holding current value the controller is configured to:

respond to an increase in the dimmer phase-cut voltage after detection of the leading edge that would otherwise cause the current through the triac to undershoot the holding current value by causing a generation of a compensating current that increases the lamp current to prevent the current through the triac from undershooting the holding current value.

16. The apparatus of claim 15 wherein to control a lamp current to prevent a current through the dimmer from undershooting a holding current value, the controller is further configured to:

generate the compensating current as a current pulse for a first duration of time as the current through the dimmer decreases.

17. The apparatus of claim 16 further comprising:

the electronic lamp; and multiple additional electronic lamps coupled in parallel with the electronic lamp to each receive a portion of the lamp current;

wherein the first duration of time is based on current control characteristics of at least a plurality of the multiple lamps.

18. The apparatus of claim 16 wherein the controller is further configured to:

retrieve data from a memory in a controller of a switching power converter, wherein the data represents the first duration of time of the current pulse.

19. The apparatus of claim 16 wherein the controller is further configured to:

ramp down the current pulse at the end of the first duration of time.

20. The apparatus of claim 15 wherein control of a lamp current to prevent a current through a triac of the dimmer from undershooting a holding current value draws an amount of excess current into a switching power converter of the electronic lamp, wherein the amount of excess current is an amount of current that exceeds an amount of current used to illuminate a light source of the electronic lamp at a brightness corresponding to the dimmer phase-cut voltage, the controller is further configured to:

dissipate power in the switching power converter that corresponds to the amount of excess current drawn.

21. The apparatus of claim 15 wherein to control a lamp current to prevent a current through the dimmer from undershooting a holding current value, the controller is further configured to:

vary an amount of lamp current drawn to prevent the undershooting in correlation with different phase-cut angles of the dimmer phase-cut voltage.

22. The apparatus of claim 21 wherein variations of the amount of lamp current drawn to prevent the undershooting for difference phase-cut angles of the dimmer phase-cut voltage are non-linear with respect to the phase-cut angles of the dimmer phase-cur angle.

23. The apparatus of claim 15 wherein to control a lamp current to prevent a current through the dimmer from undershooting a holding current value, the controller is further configured to:

superimpose the lamp current on the current through the dimmer to prevent the current through the dimmer from undershooting the holding current value.

24. The apparatus of claim 15 wherein the controller is further configured to:

wait for a first duration of time after detecting the leading edge before controlling the lamp current to prevent the current through the dimmer from undershooting the holding current value.

25. The apparatus of claim 24 wherein the first duration of time after detecting the leading edge begins after the current through the dimmer has a negative change over time and before the current through the dimmer reaches the holding current value.

26. The apparatus of claim 15 wherein the dimmer is a triac-based dimmer and triac-based dimmer conducts current provided to a non-homogenous set of light emitting diode-based lamps.

27. The apparatus of claim 15 wherein to respond to an increase in the dimmer phase-cut voltage after detection of the leading edge that would otherwise cause the current through the triac to undershoot the holding current value by causing a generation of a compensating current the controller is further configured to:

dynamically detect an indication of a possible undershoot of the holding current value; and upon detection of the indication, control the lamp current to prevent the current through a triac of the dimmer from undershooting the holding current value.

28. The apparatus of claim 15 wherein the electronic lamp comprises one or more light emitting diodes.

29. The apparatus of claim 15 further comprising:

the electronic lamp; and multiple additional electronic lamps coupled in parallel with the electronic lamp.

30. The apparatus of claim 15 further comprising:

the electronic lamp, wherein the electronic lamp includes a switching power converter coupled to the controller and further includes one or more light emitting diodes coupled to the switching power converter.

31. An apparatus comprising:

a lamp, wherein the lamp comprises:

a switching power converter;

one or more light emitting diodes coupled to the switching power converter; and a controller, coupled to the switching power converter, wherein the controller is configured to:

detect a leading edge of a dimmer phase-cut voltage;

after detecting the leading edge, control a lamp current of the lamp to prevent a current through a triac of the dimmer from undershooting a holding current value, wherein the holding current value represents a value that if undershot by the current through the triac of the dimmer would stop the triac from conducting, wherein to the lamp current of the electronic lamp to prevent the current through the triac of the dimmer from undershooting the holding current value the controller is configured to:

respond to an increase in the dimmer phase-cut voltage after detection of the leading edge that would otherwise cause the current through the triac to undershoot the holding current value by causing a generation of a compensating current that increases the lamp current to prevent the current through the triac from undershooting the holding current value.

32. The method of claim 1 wherein responding to an increase in the dimmer phase-cut voltage after detection of the leading edge that would otherwise cause the current through the triac to undershoot the holding current value by causing a generation of a compensating current further comprises:

accessing a memory that includes current profiles of all lamps coupled to the triac, and;

generating the compensating current based on information in the current profiles that indicate when the current through the dimmer would undershoot the holding current value without the compensating current.

33. The method of claim 1 wherein responding to an increase in the dimmer phase-cut voltage after detection of the leading edge that would otherwise cause the current through the triac to undershoot the holding current value by causing a generation of a compensating current further comprises:

predicting a possibility of the undershoot of the holding current value; and generating the compensating current in anticipation of the undershoot of the holding current to prevent the current through the dimmer from undershooting the holding current value.

34. The apparatus of claim 15 wherein to respond to an increase in the dimmer phase-cut voltage after detection of the leading edge that would otherwise cause the current through the triac to undershoot the holding current value by causing a generation of a compensating current the controller is further configured to:

access a memory that includes current profiles of all lamps coupled to the triac, and;

generate the compensating current based on information in the current profiles that indicate when the current through the dimmer would undershoot the holding current value without the compensating current.

35. The apparatus of claim 15 wherein to respond to an increase in the dimmer phase-cut voltage after detection of the leading edge that would otherwise cause the current through the triac to undershoot the holding current value by causing a generation of a compensating current the controller is further configured to:

predict a possibility of the undershoot of the holding current value; and generate the compensating current in anticipation of the undershoot of the holding current to prevent the current through the dimmer from undershooting the holding current value.

* * * * *